US009968195B2

(12) United States Patent
Sheinkop

(10) Patent No.: US 9,968,195 B2
(45) Date of Patent: May 15, 2018

(54) ADJUSTABLE SEAT AND LEANING APPARATUS

(71) Applicant: Ergo Impact, LLC, Highland Park, IL (US)

(72) Inventor: Jonathan Sheinkop, Highland Park, IL (US)

(73) Assignee: Ergo Impact, LLC, Highland Park, IL (US)

( * ) Notice: Subject to any disclaimer, the term of this patent is extended or adjusted under 35 U.S.C. 154(b) by 0 days. days.

(21) Appl. No.: 15/297,966

(22) Filed: Oct. 19, 2016

(65) Prior Publication Data

US 2017/0105530 A1 Apr. 20, 2017

Related U.S. Application Data

(60) Provisional application No. 62/346,046, filed on Jun. 6, 2016, provisional application No. 62/243,912, filed on Oct. 20, 2015.

(51) Int. Cl.

| | |
|---|---|
| ***A47C 9/02*** | (2006.01) |
| ***A47C 1/00*** | (2006.01) |
| ***A47C 1/022*** | (2006.01) |
| ***A47C 7/00*** | (2006.01) |
| ***A47C 3/40*** | (2006.01) |
| ***A47C 3/34*** | (2006.01) |
| ***A47C 7/50*** | (2006.01) |

(52) U.S. Cl.

CPC ..... *A47C 1/022* (2013.01); *A47C 3/34* (2013.01); *A47C 3/40* (2013.01); *A47C 7/002* (2013.01); *A47C 7/006* (2013.01); *A47C 7/50* (2013.01); *A47C 9/025* (2013.01)

(58) Field of Classification Search

CPC ..... A47C 1/022; A47C 7/002; A47C 7/006; A47C 7/50; A47C 3/40; A47C 3/34; A47C 9/025

USPC ..... 297/195.11, 452.27, 344.18, 344.19

See application file for complete search history.

(56) References Cited

U.S. PATENT DOCUMENTS 406,328 A * 7/1889 Yagn ..... A63B 25/10 297/4

444,621 A * 1/1891 Schneider ..... A45B 5/00 135/66

(Continued)

FOREIGN PATENT DOCUMENTS

DE 3201335 A1 * 7/1983 ..... A47C 9/025

*Primary Examiner* — Rodney B White

(74) *Attorney, Agent, or Firm* — Jared W. Radkiewicz

(57) ABSTRACT

An adjustable seating solution that enables users to adjust several seating characteristics is disclosed. In a relatively low sitting position, the disclosed device provides some support if the user leans back, but predominately supports the user's weight and requires the user to engage core muscles to maintain good posture. The disclosed apparatus enables the user to adjust the seat upward to a leaning position. A platform extends forward under the user's feet to ensure that when the user leans against the seat, the apparatus remains stable. The apparatus enables the seat portion to be tilted, such that varying contours can be selected to engage the user's body in a desired way. At low heights, the user can tilt the seat portion forward to require the user to further engage core muscles while seated. At higher heights, the user can customize the contour of the seat that engages the user's body.

20 Claims, 25 Drawing Sheets

(56) References Cited

U.S. PATENT DOCUMENTS 483,266 A * 9/1892 Schindler ..... B60N 2/1892 248/397
635,234 A * 10/1899 Chance ..... A47C 3/0255 297/195.11
1,065,022 A * 6/1913 Bell ..... A47C 9/005 248/413
2,369,289 A * 2/1945 Fallon, Sr. ..... A47C 3/34 297/195.11
2,508,932 A * 5/1950 Turner ..... A47C 3/24 297/195.11 X
2,552,592 A * 5/1951 Rush ..... A61B 6/04 297/195.11 X
2,850,077 A * 9/1958 Dawson ..... A47C 9/022 248/414
3,294,440 A * 12/1966 Broder ..... A47C 3/34 248/188.5
3,310,340 A * 3/1967 Brewer ..... A45B 5/00 108/128
3,477,673 A * 11/1969 Bereday ..... A47C 9/025 248/121
3,712,574 A * 1/1973 Rothermel ..... A47C 3/34 248/409
3,754,787 A * 8/1973 Garber ..... A47C 9/025 297/195.11
3,891,270 A * 6/1975 Crossman ..... A47C 3/30 248/404
4,064,578 A * 12/1977 Yamada ..... A47C 7/021 297/452.27
4,098,478 A * 7/1978 Spitzke ..... A47C 9/10 108/115
4,108,462 A * 8/1978 Martin ..... B62J 1/00 248/286.1
4,130,263 A * 12/1978 Roericht ..... A47C 9/025 297/195.11 X
4,183,579 A * 1/1980 Gonzalez y. Rojas ..... A47C 9/025 297/195.11 X
4,279,398 A * 7/1981 Pregnall ..... A47C 3/24 114/363
4,366,981 A * 1/1983 Ziegler ..... A47C 9/025 248/188.9
4,469,372 A * 9/1984 Long ..... A47C 9/002 248/188.7
4,552,404 A * 11/1985 Congleton ..... A47C 1/022 297/330
4,632,410 A * 12/1986 Bainbridge ..... A47C 13/00 280/32.5
4,803,945 A * 2/1989 Adams ..... B63B 29/04 114/363
4,819,288 A * 4/1989 Lowthian ..... A47C 7/18 297/452.27
4,863,178 A * 9/1989 Friesen ..... B25H 5/00 182/116
4,865,382 A * 9/1989 Marshall ..... A47C 9/025 297/195.11 X
4,867,273 A * 9/1989 Schaevitz ..... A47C 9/025 182/116
4,889,387 A * 12/1989 Gregory ..... A47C 7/022 297/452.27
4,932,719 A * 6/1990 Gonzalez y. Rojas ..... A47C 9/025 297/195.11 X
5,054,852 A * 10/1991 Tholkes ..... A47B 83/02 297/172
5,149,174 A * 9/1992 Charash ..... A47C 9/005 248/125.1
5,186,519 A * 2/1993 Larson ..... A47C 9/005 297/338
5,199,763 A * 4/1993 Wilder ..... A47C 9/025 297/15
D336,790 S 6/1993 Louers
5,295,728 A * 3/1994 Schaevitz ..... A47C 9/02 297/195.1
5,524,658 A * 6/1996 Schrader ..... A61H 3/00 135/72
5,591,208 A * 1/1997 Knutson ..... A61G 5/14 601/24
5,630,648 A * 5/1997 Allard ..... A47C 9/025 297/302.1
5,927,797 A * 7/1999 Ferguson ..... A47C 9/025 297/4
6,062,638 A * 5/2000 Ferguson ..... A47C 9/025 297/4
6,540,301 B1 * 4/2003 Bottoms ..... A47C 9/025 135/65
6,595,590 B2 * 7/2003 Bottoms ..... A47C 9/025 135/66
6,824,149 B1 * 11/2004 Whitlock ..... B25H 5/00 280/32.6
6,893,097 B1 * 5/2005 Ebensperger ..... A47C 9/10 297/195.11 X
6,959,716 B1 * 11/2005 Schrader ..... A45B 3/00 297/195.11 X
6,997,511 B2 * 2/2006 Marchand ..... A47C 9/025 297/313
7,077,469 B2 * 7/2006 Badia i Farre ..... A47C 3/20 297/195.11
7,293,825 B2 * 11/2007 Vergara ..... A47C 9/002 297/1
7,293,827 B2 * 11/2007 Schrader ..... A45B 3/00 297/195.11 X
7,367,623 B2 * 5/2008 Tholkes ..... A47C 9/005 297/300.8
7,396,083 B2 * 7/2008 Kasner ..... A01K 97/00 297/195.11 X
7,530,640 B2 * 5/2009 Walters ..... A47C 7/022 297/452.27 X
7,594,696 B2 * 9/2009 Girard ..... A47C 9/025 297/195.11 X
7,726,729 B2 * 6/2010 Groll ..... A47C 9/025 297/252
7,887,136 B2 2/2011 Zoell
8,136,876 B2 * 3/2012 Bellvis Castillo ..... A47C 9/002 297/195.11
8,220,872 B2 7/2012 Hong
8,403,408 B2 * 3/2013 Hosler ..... A47C 9/025 297/4
8,496,292 B2 * 7/2013 Strassberg ..... A47C 3/20 297/195.11
8,540,314 B2 * 9/2013 Fernandez ..... A47C 3/30 297/314
8,540,519 B1 * 9/2013 Lauter ..... A63B 26/003 434/247
8,544,943 B2 * 10/2013 Fields ..... A47C 1/11 297/195.11 X
D697,328 S 1/2014 Keen et al.
8,646,841 B2 * 2/2014 Molnar ..... A47C 7/004 297/344.21
D702,450 S 4/2014 Bridgewater, Jr.
8,998,319 B2 * 4/2015 Bahneman ..... A47C 9/00 297/195.11
9,474,377 B2 * 10/2016 Keen ..... A47C 7/506
2002/0140259 A1 * 10/2002 Wiegand ..... A47C 7/14 297/195.11
2003/0230915 A1 * 12/2003 Checketts ..... A47C 9/025 297/195.11
2005/0088029 A1 * 4/2005 Stokes ..... A47C 9/025 297/461
2005/0242630 A1 * 11/2005 Miller ..... A01K 97/00 297/4
2006/0232109 A1 * 10/2006 Olano ..... A47C 3/04 297/195.11
2007/0216205 A1 * 9/2007 Davis ..... A47C 1/06 297/241
2007/0241523 A1 * 10/2007 Lewman ..... B25H 5/00 280/32.5

(56) References Cited

U.S. PATENT DOCUMENTS

| | | | | |
|---|---|---|---|---|
| 2008/0150331 | A1* | 6/2008 | Chen | A63B 21/00 297/195.11 |
| 2010/0026078 | A1* | 2/2010 | Abdoli-Eramaki | A47C 1/022 297/464 |
| 2013/0031712 | A1* | 2/2013 | Gossett | A47C 3/34 4/496 |
| 2013/0123074 | A1* | 5/2013 | Jun | A63B 21/00196 297/195.11 X |
| 2013/0306831 | A1 | 11/2013 | Keen et al. | |
| 2016/0192780 | A1* | 7/2016 | Sinclair | A47C 4/04 297/195.11 X |
| 2017/0128310 | A1* | 5/2017 | Roeder | A61H 1/0229 |
| 2017/0245646 | A1* | 8/2017 | Zoell | A47C 7/563 |
| 2018/0014653 | A1* | 1/2018 | Reynolds | A47C 7/62 |

* cited by examiner

ADJUSTABLE SEAT AND LEANING APPARATUS

PRIORITY CLAIM is a non-provisional of, and claims priority to and the benefit of U.S. Provisional Patent Application No. 62/346,046, filed on Jun. 6, 2016, and U.S. Provisional Patent Application No. 62/243,912, filed on Oct. 20, 2015, which are both incorporated by reference herein in their entirety.

COPYRIGHT NOTICE

A portion of the disclosure of this patent document contains material that is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

With the large number of people who spend upwards of eight hours every day seated at a desk or in front of a computer screen, the health impacts and considerations of professions requiring such sedentary schedules have become an important issue. Individuals who spend their days seated in front of a desk or screen are concerned about potential health impacts such as back injury, eye fatigue, and general muscular atrophy. Employers whose employees spend their days seated are concerned about these health issues as well as the productivity of their employees.

Substantial effort has been expended to develop seating solutions that attempt to reduce the strain on peoples' bodies, thereby ideally reducing negative health impacts and increasing productivity. For example, many office chair designers have resorted to using mesh seating materials to conform to users' bodies, and have provided several adjustable components (including adjustable lumbar support members) to allow users to customize the size and shape of their chairs to their bodies. While these efforts have resulted in chairs that provide more comfort and customization, these efforts are nonetheless inadequate to provide completely customizable seating solutions.

Other efforts have focused on raised solutions designed to be "perched" on, and not as standing solutions against which a user can lean. For example, in such solutions, a user can position adjustable padded devices at an appropriate height to sit or "perch" on top of a stool-like seating portion. In this way, users can comfortably sit at a higher than standard height in front of a raised desk or computer screen, enabling legs to be more fully extended than when sitting in a standard-height office chair.

Such solutions are nonetheless also inadequate, as there are no known solutions that provide users with the choice to either stand and lean against a piece of furniture or sit as desired. These solutions are also inadequate because while the height is adjustable, the contour of the portion of the apparatus that engages the user's body is not adjustable to different uses or comfort desires.

Thus, although there have been efforts to develop customizable, comfortable workplace seating solutions, considerable shortcomings remain.

SUMMARY

An adjustable seating solution that enables users to adjust several seating characteristics, including several different contoured portions of the seating solution, is disclosed. The apparatus enables the user to select a desired seat height. In a sitting position, the disclosed device provides some support if the user leans back, but still beneficially requires the user to engage core muscles to maintain good posture. The disclosed apparatus enables the user to adjust the seat upward to a leaning position. A platform that extends forward under the user's feet ensures that even when the user leans against the seat, the apparatus remains stable. Finally, the disclosed apparatus enables the seat portion to be tilted as desired. In this embodiment, at low heights, the user can tilt the seat portion forward to require the user to further engage core muscles while seated. At higher heights, the user can customize the contour of the seat that engages the user's body.

The seating apparatus disclosed herein provides for substantially more adjustability than known seating apparatus, and enables users to change their seating or standing position through the course of a day. Specifically, the disclosed apparatus enables users to move from a seated position, in which core muscles are engaged to maintain good posture, to a partial standing position in which the user's legs must partially support his or her body weight, to a fully standing position in which the user's legs fully support his or her body weight. In each of these positions, the disclosed apparatus enables the user to select a seat tilt, and the unique shape of the seat portion provides for selectable contour of the seat portion that engages the user's body. These varying positions are described in more detail below with respect to the figures.

In various embodiments, a height adjustment mechanism enables the user to adjust the distance of a seat portion from a base portion of a seating apparatus, and thus to adjust the height of the seat portion of the apparatus relative to the user's body. In these embodiments, the disclosed seating apparatus enables the user to easily convert the apparatus from a chair-like or stool-like device to a leaning device, and enables the user to select different points on his or her body with which the seating apparatus will come into contact. In addition, because of the ability to adjustably tilt the seat portion of the disclosed apparatus, the user can select the amount and contour of the seat portion that comes into contact with the selected portion of his or her body. In this way, if a user wishes to stand and lean against the seating apparatus, the user can tilt the seat so that relatively focused pressure is placed on a small section of the user's body (e.g., the lumbar region of the user's back). Likewise, if the user wishes to partially sit and partially stand, the user can adjust the height and tilt of the seat portion to provide for such a configuration.

Embodiments of the disclosed apparatus therefore improve known seating solutions by providing users with more control over the height and contour of the seat portion presented for engagement with the user's body. Throughout the user's day, the user can adjust the seating apparatus as appropriate for different tasks and according to whether the user feels pain or wishes to engage his or her legs and core in different ways.

Additional benefits of the disclosed seating apparatus will become apparent from the attached figures and the following detailed description.

DETAILED DESCRIPTION

The seating apparatus disclosed herein provides for substantially more adjustability than known seating apparatus, and enables users to change their seating or standing position through the course of a day. Specifically, the disclosed apparatus enables users to move from a seated position, in which core muscles are engaged to maintain good posture, to a partial standing position, in which the user's legs must partially support his or her body weight, to a fully standing position in which the user's legs fully support his or her body weight. In each of these positions, the disclosed apparatus enables the user to select a seat tilt, and the unique shape of the seat portion provides for selectable contour of the seat portion that engages the user's body. These varying positions are described in more detail below with respect to the figures.

Figure 1:
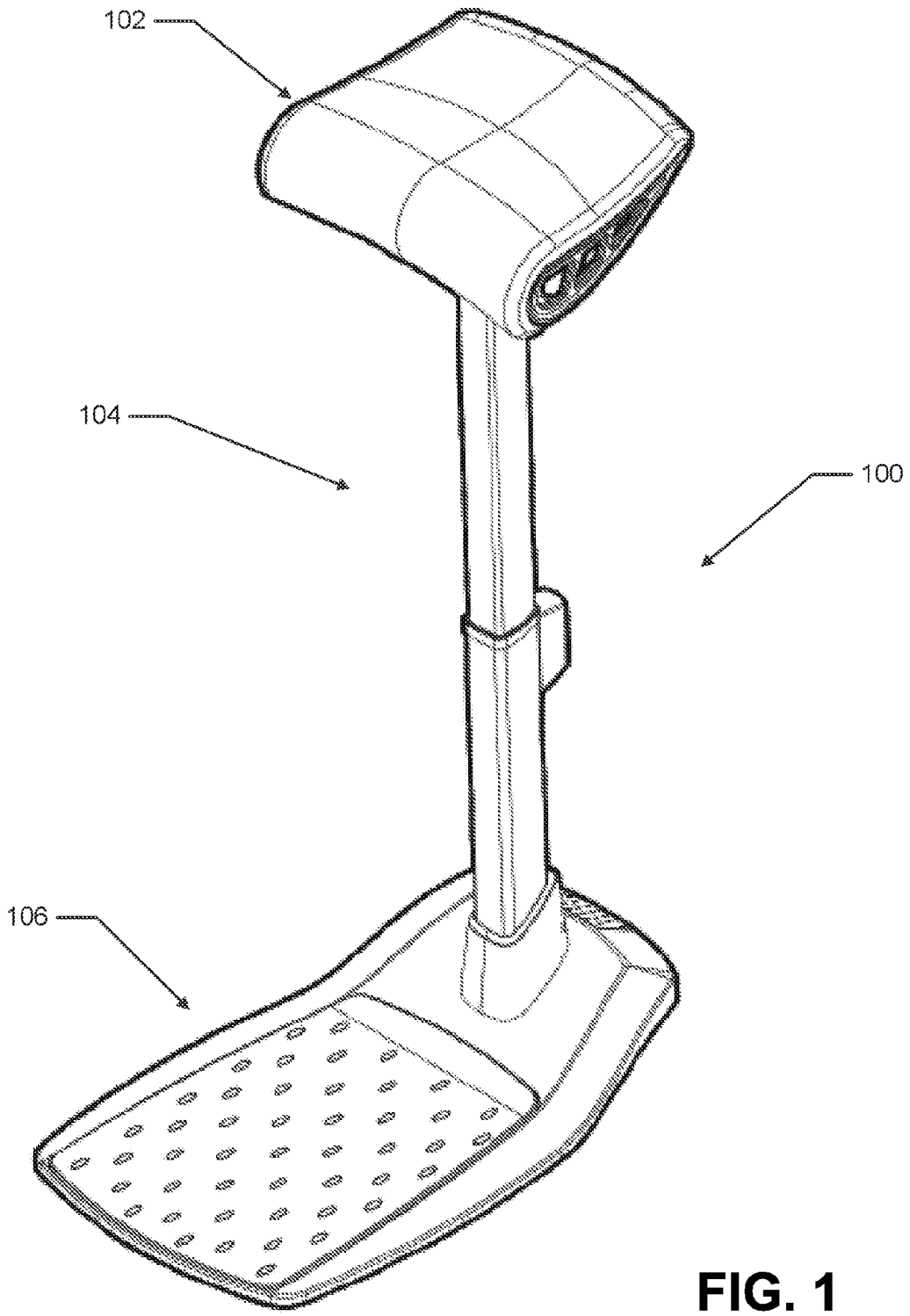
FIG. 1 illustrates a perspective view of one embodiment of the disclosed seating solution.

Referring now to FIG. 1, one embodiment of the disclosed seating apparatus 100 is illustrated in perspective view. In this embodiment, the seating apparatus 100 includes several major sub-components, which will be discussed in more detail below. For example, the embodiment of FIG. 1 includes a seat portion 102. Seat portion 102 engages with different parts of the user's body depending on the height and position of the seat portion 102. FIG. 1 also illustrates an adjustable stem portion 104 and a base portion 106. The adjustable stem portion 104 enables the height of the seat portion 102 to be adjusted with regard to the base portion 106, as will be discussed in more detail below.

Figure 2:
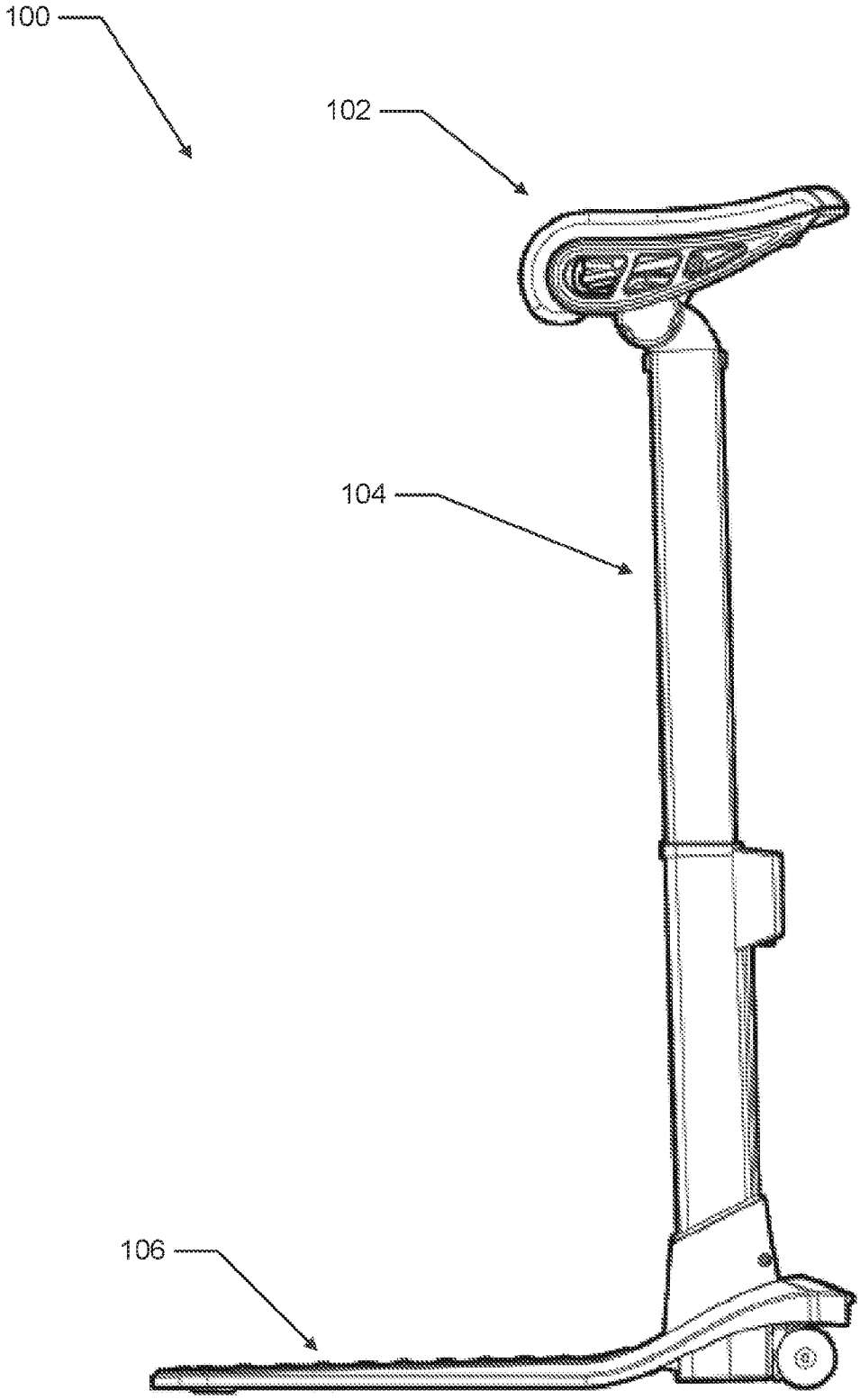
FIG. 2 illustrates a side view of one embodiment of the disclosed seating solution.

Referring now to FIG. 2, a side view of the seating apparatus 100 illustrated in FIG. 1 is shown. In this embodiment, the seat portion 102 can be seen in cross-section, the adjustable stem portion 104 can be seen more clearly, and the base portion 106 can be seen in cross section.

Figure 3:
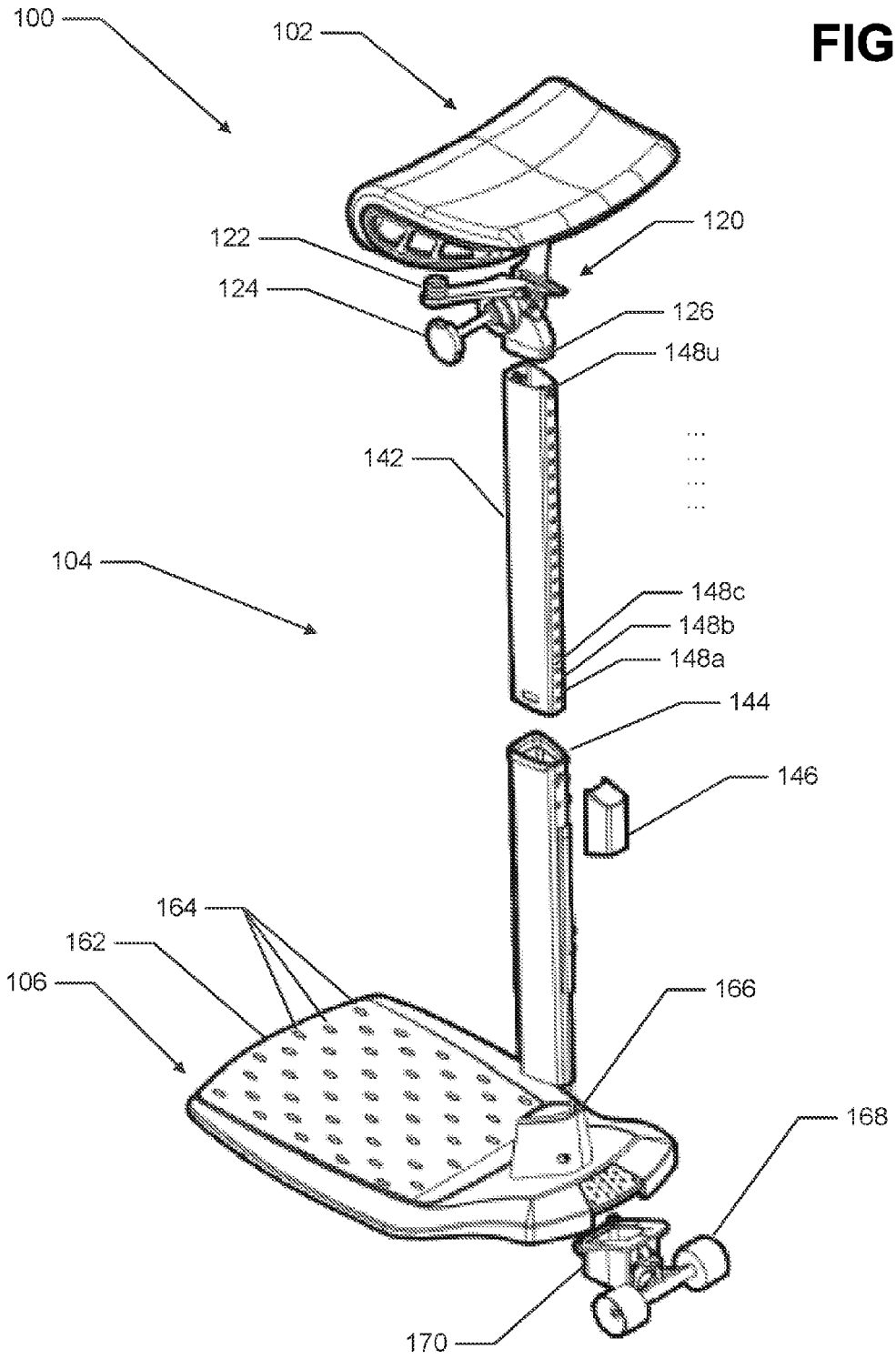
FIG. 3 illustrates an exploded view of one embodiment of the disclosed seating solution.

FIG. 3 illustrates an exploded view of the seating apparatus 100 illustrated in FIGS. 1 and 2. Several additional details of the different major subcomponents of the seating apparatus 100 can be seen in the exploded view of FIG. 3 and will be discussed in detail here.

First, referring to the seating portion 102 of FIG. 3, it can be seen that the seat portion 102 includes a seat adjustment subassembly 120. The seat adjustment subassembly 120 includes at least one compression spring 122 that provides a cushioning effect when a user sits on or leans against the seat portion 102. The seat portion 102 also includes an adjustment knob 124 to enable the user to adjust the angle or tilt of the seat portion 102. The seat portion 102 also includes a stem engagement portion 126 that is sized and shaped to fit within and be secured to the top of the adjustable stem portion 104, such as with appropriate bolts or screws. As can be seen, the adjustment knob 124 can be loosened, the seat portion 102's tilt adjusted, and the adjustment knob 124 re-tightened with the seat portion 102 at the desired tilt. In this way, the illustrated embodiment enables the user to adjust the tilt of the seat portion 102 relative to the stem engagement portion 126, and thus with respect to the adjustable stem portion 104.

Referring now to the adjustable stem portion 104 of FIG. 3, the adjustable stem portion 104 is seen to include nesting movable components 142 and 144. In this embodiment, nesting portion 142 receives the stem engagement portion 126 of the seat portion 102, which is secured in place using screws, bolts, welds, or the like. Nesting portion 142 fits within the sleeve formed by nesting portion 144, such that the nesting portion 142 can move along the axis of the adjustable stem portion 104 to adjust the distance between the seat portion 102 and the base portion 106. In the illustrated embodiment, adjustment lock 146 is provided to enable the relative positions of nesting movable components 142 and 144 to be fixed relative to one another. Adjustment lock 146 is a spring-mounted graspable component that when pulled away from the nesting portion 144, withdraws a boss that extends within the volume of the nesting movable component 144. Withdrawing the boss causes the boss to disengage from any hole 148*a*, 148*b*, 148*c* . . . 148*u* in which it had been previously seated. In one embodiment, even when the boss is withdrawn from holes 148*a*, 148*b*, 148*c* . . . 148*u*, it remains within hole 150 to ensure that when the adjustment lock 146 is released, the boss returns to its original position by extending normal to the axis of the moveable components 142 and 144. Once withdrawn from such hole 148*a*, 148*b*, 148*c* . . . 148*u*, the nesting portion 142 can be moved as desired. When an appropriate height is achieved, the user releases the adjustment lock 146, causing the boss to engage a corresponding hole 148*a*, 148*b*, 148*c* . . . 148*u* and locking the seat portion 102 at the desired distance from the base portion 106. It should be appreciated that in various embodiments, different locking mechanisms may be used to ensure the nesting portions 142 and 144 do not move relative to one another, such as screws, bolts, pressure-based mechanisms, or the like. In some embodiments, nesting portion 142 is configured to encircle nesting portion 144, for example to provide for a different or more aesthetically pleasing appearance.

The base portion 106 of FIG. 3 includes a platform portion 162. In the illustrated embodiment, platform portion 162 includes three-dimensional features 164 that improve traction when a user stands on the platform portion 162 during use of the seating apparatus 100. In one embodiment, these features are made from rubber which is used to coat the platform portion 162. In other embodiments, these features 164 could be much smaller or could be made from different materials than the platform portion 162 to further approve traction and aesthetics as desired. Base portion 106 also includes a stem engagement portion 166 into which adjustable stem 104 nests. In this embodiment, appropriate hardware, such as screws, bolts, or welds, are used to secure the stem portion 104 to the base portion 106. It should be appreciated that in various embodiments, the stem portion 104 is removable from the base portion 106 or is more permanently affixed to the base portion 106. Finally, base portion 106 includes seat movement assembly 166. In the illustrated embodiment, the seat movement assembly 166 is a set of wheels, such that a user can tip the seating apparatus 100 backward onto the wheels and roll the apparatus around a room as desired. It should be appreciated that in this embodiment, when the seating apparatus is resting flat on the ground, the wheels touch the ground. Moreover, in the illustrated embodiment, the fact that the wheels 166 prevent or resist a backward tipping, making the apparatus more stable and less likely to accidentally tip backward while in use. Thus, in the illustrated embodiment, the user can easily tilt the entire seating apparatus 100 backward onto the wheels to easily move it. In other embodiments, other devices can be used as movement assembly 100, such as skids or casters, depending on the surface of intended use of the seating assembly 100. For example, if the seating assembly 100 is intended for use on carpeted surfaces, skids or other smooth, immovable structures may be sufficient to enable the device to be slid to an appropriate position. In the illustrated embodiment, it should be appreciated that ground engagement portion 170 is configured to rest flat on the ground when the seating apparatus 100 is not being moved. As such, any force applied downward to the seat portion 102 is directly supported by the ground through ground engagement portion 170.

Figure 4:
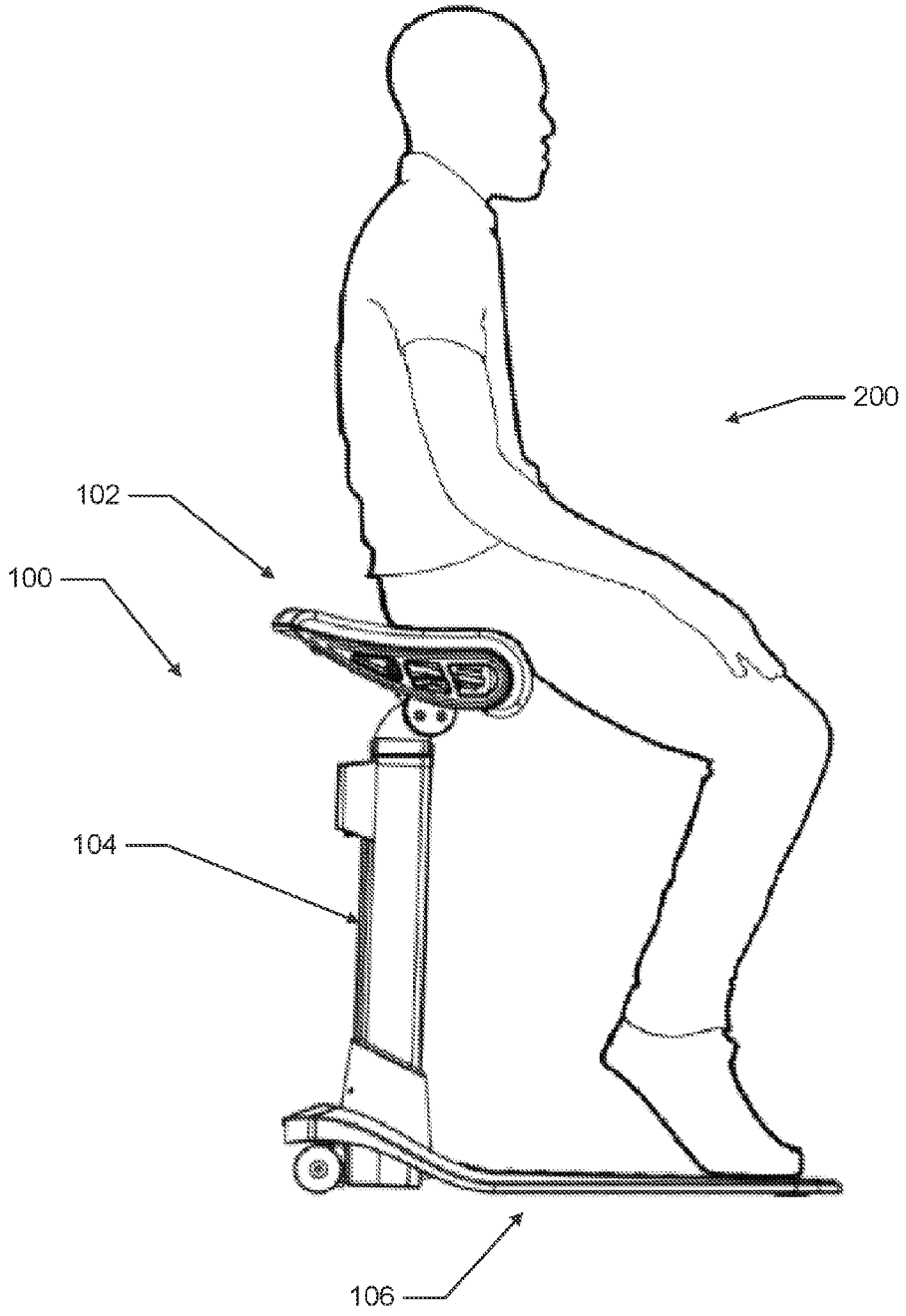
FIG. 4 illustrates a side view of one embodiment of the disclosed seating solution in a relatively low, seated position.

FIG. 4 illustrates a side view of the device described above with regard to FIGS. 1-3, wherein the seat portion 102 has been adjusted to a height appropriate for person 200 to sit on the seat portion 102. In the illustrated embodiment, it should be appreciated that the majority of the person's 200 weight is supported vertically by the seat portion 102, but that the person's feet are nonetheless resting on the base portion 106. In this embodiment, the seating apparatus 100 provides substantial support for the person's weight, but the person's feet engaging the base portion 106 nonetheless provide an anchoring functionality because the person's 200 body weight prevents the seating apparatus 100 from tipping backward. As can be appreciated, in the illustrated embodiment the person's 200 feet are not flat on the base portion 106. This indicates that while some of the person's body weight is being applied to the base portion 106, the majority of the body weight is nonetheless supported by the seat portion 102. In the illustrated embodiment, the contour of the seat portion 102 also provides for a small amount of support for the person's 200 back, as it curves upward toward the person's 200 lower back. Accordingly, contrasted with a seat that is completely parallel to the floor, the seat portion 102 provides additional back support while still requiring the person's 200 core to engage to maintain good posture while seated.

Figure 5:
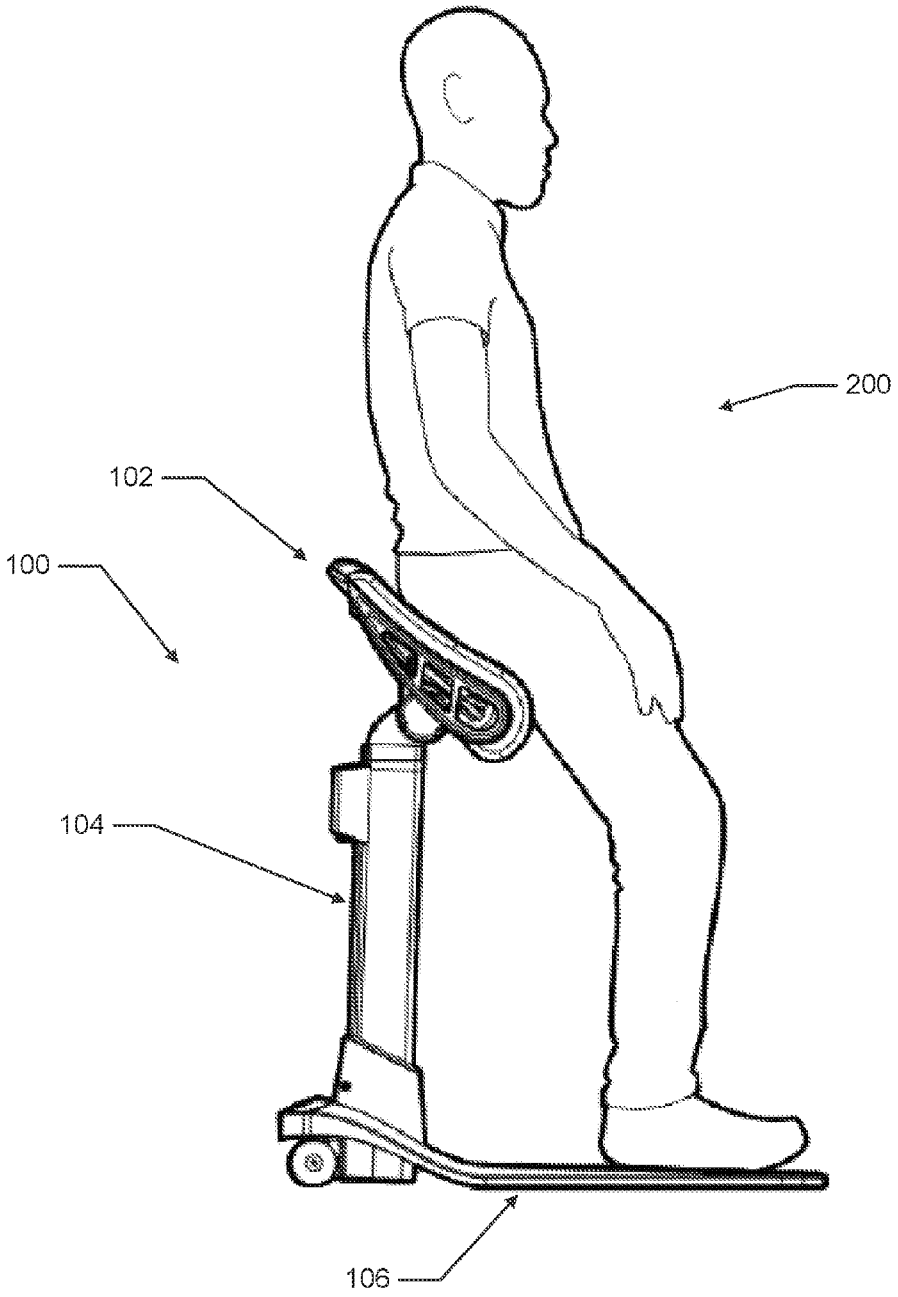
FIG. 5 illustrates a side view of one embodiment of the disclosed seating solution in a relatively higher leaning position, with the seat portion tilted forward to accommodate a partial leg bend.

FIG. 5 illustrates a side view of the device described above with regard to FIGS. 1-3, wherein the seat portion 102 has been adjusted to a height appropriate for person 200 to lean against the seat portion 102 with legs slightly bent (i.e., a position between sitting and standing). In the illustrated embodiment, the seating apparatus 100 provides some support for the person's 200 weight, and the person's feet engaging the base portion 106 provide substantial support for the person's weight. Moreover, because of the amount of the person's 200 body weight borne by the base portion 106, the person's 200 body weight provides much of the stability of the seating apparatus 100 and prevents it from tipping backward. In the illustrated embodiment, the seat portion 102 has been tilted forward as contrasted with the embodiment of FIG. 4 to match the contour of the seat portion 102 to the person's 200 body at the desired seat height. It should be appreciated that in the illustrated embodiment, because of the hybrid standing/sitting position, the seat portion 102 provides both support for the person's body weight and lower back support to assist in maintaining good posture while reducing strain on the person's 200 lower back.

Figure 6:
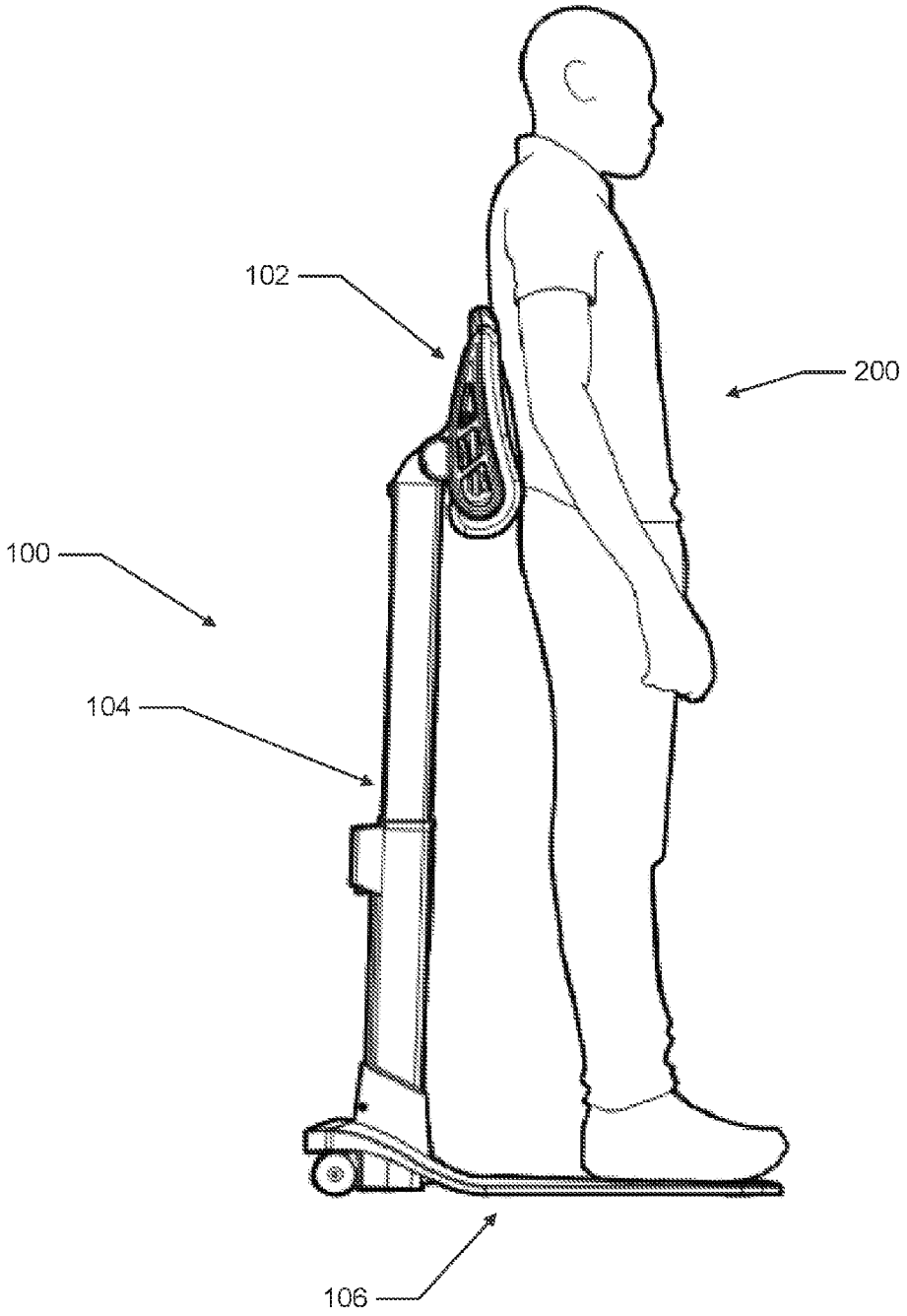
FIG. 6 illustrates a side view of one embodiment of the disclosed seating solution in a still higher standing position, with the seat portion tilted forward to accommodate a large, flat engagement with the user's lower back.
Figure 7:
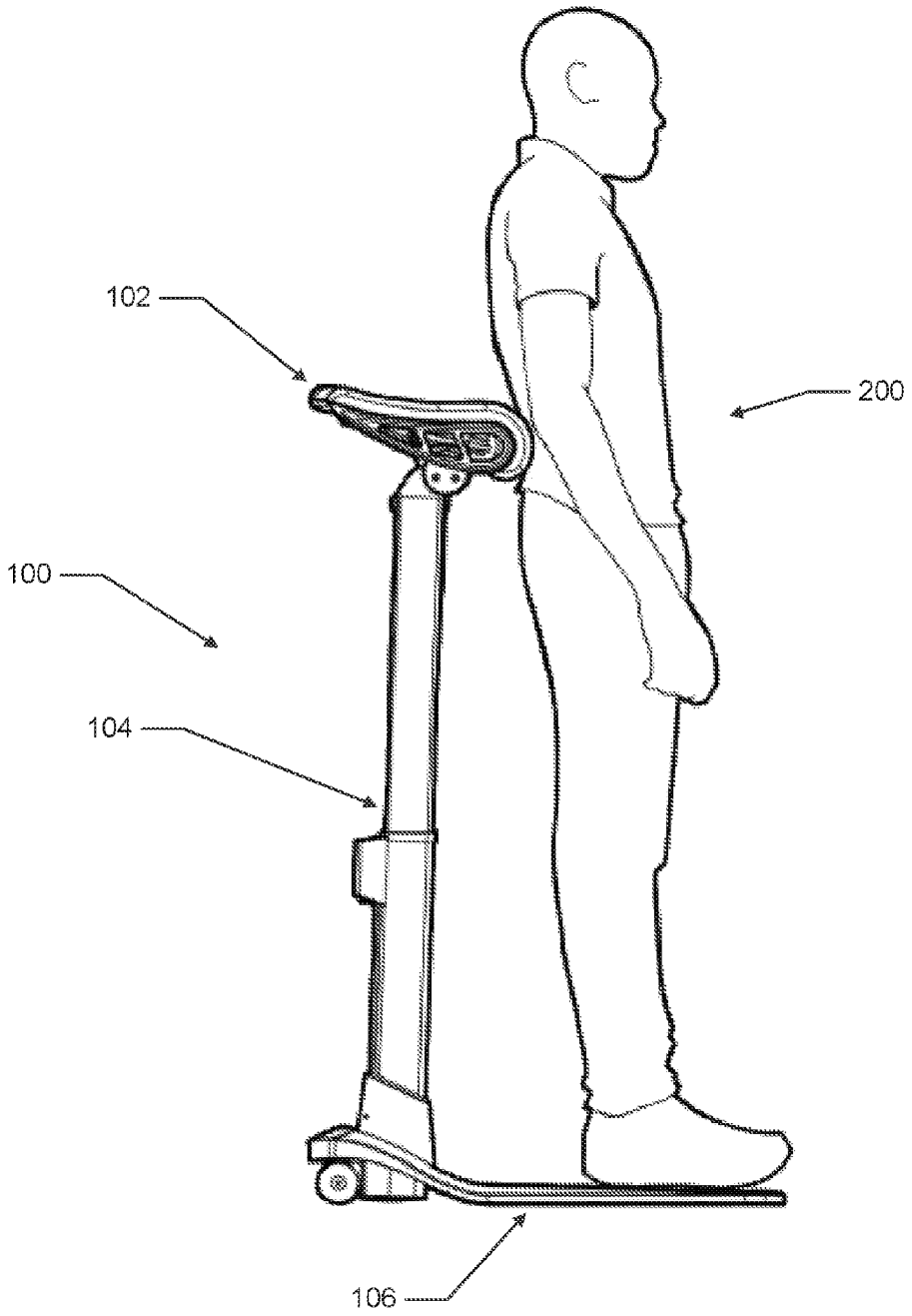
FIG. 7 illustrates a side view of one embodiment of the disclosed seating solution in the higher standing position of FIG. 6, with the seat portion tilted back to accommodate a smaller, rounder engagement with the user's lower back.

FIGS. 6 and 7 illustrate the seating apparatus 100 with the seat portion 102 extended upward to facilitate the person 200 standing fully upright. In the illustrated embodiments, the person's 200 body weight is fully supported by the base portion 106, and thus the person's 200 body weight prevents the seating apparatus 100 from tipping over backward. In the illustrated embodiments, although the person's body weight is fully supported by the base portion 106 (i.e., the person is standing completely upright), the seat portion 102 can nonetheless provide for lower back support and enable the person to lean against the seating apparatus 100 to reduce fatigue associated with standing unassisted.

Specifically, in the embodiment of FIG. 6, the seat portion 102 is tilted to a fully vertical position, such that the long dimension of the seat portion 102 (and its associated contour) provides for more distributed lower back support. In the embodiment of FIG. 7, the seat portion 102 is tilted to a fully horizontal position, such that the short dimension of the seat portion 102 (and its associated contour) provides for more focused support on a particular region of the user's 200 back (e.g., the lumbar region). In the illustrated embodiment, the capability to tilt the seat portion to provide for different contours against different parts of the user's body represents a substantial improvement over known seating apparatus. It also provides the capability for a user to adjust the seating apparatus 100 throughout the course of a day, for example to provide for more focused lumbar support toward the end of a work day. In addition, in embodiments where different portions of the seat have different amounts and densities of paddings, the ability to tilt the seat portion enables the user to select the density and thickness of the padding against which he or she is leaning.

Figure 8:
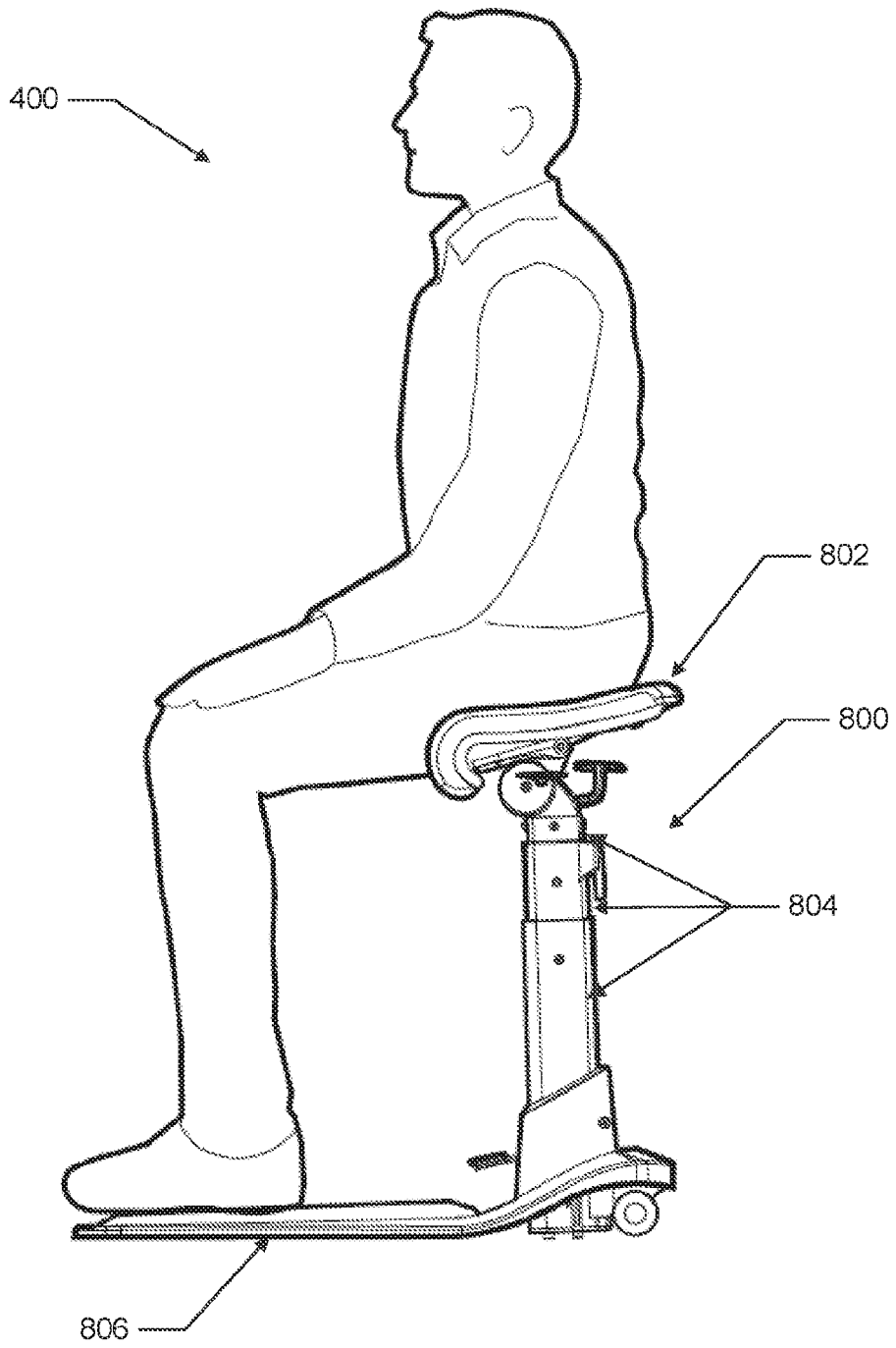
FIGS. 8, 9, 10*a*, and 10*b* illustrate a side view of another embodiment of the disclosed seating solution positioned at varying heights and with a seat portion tilted to varying angles.
Figure 9:
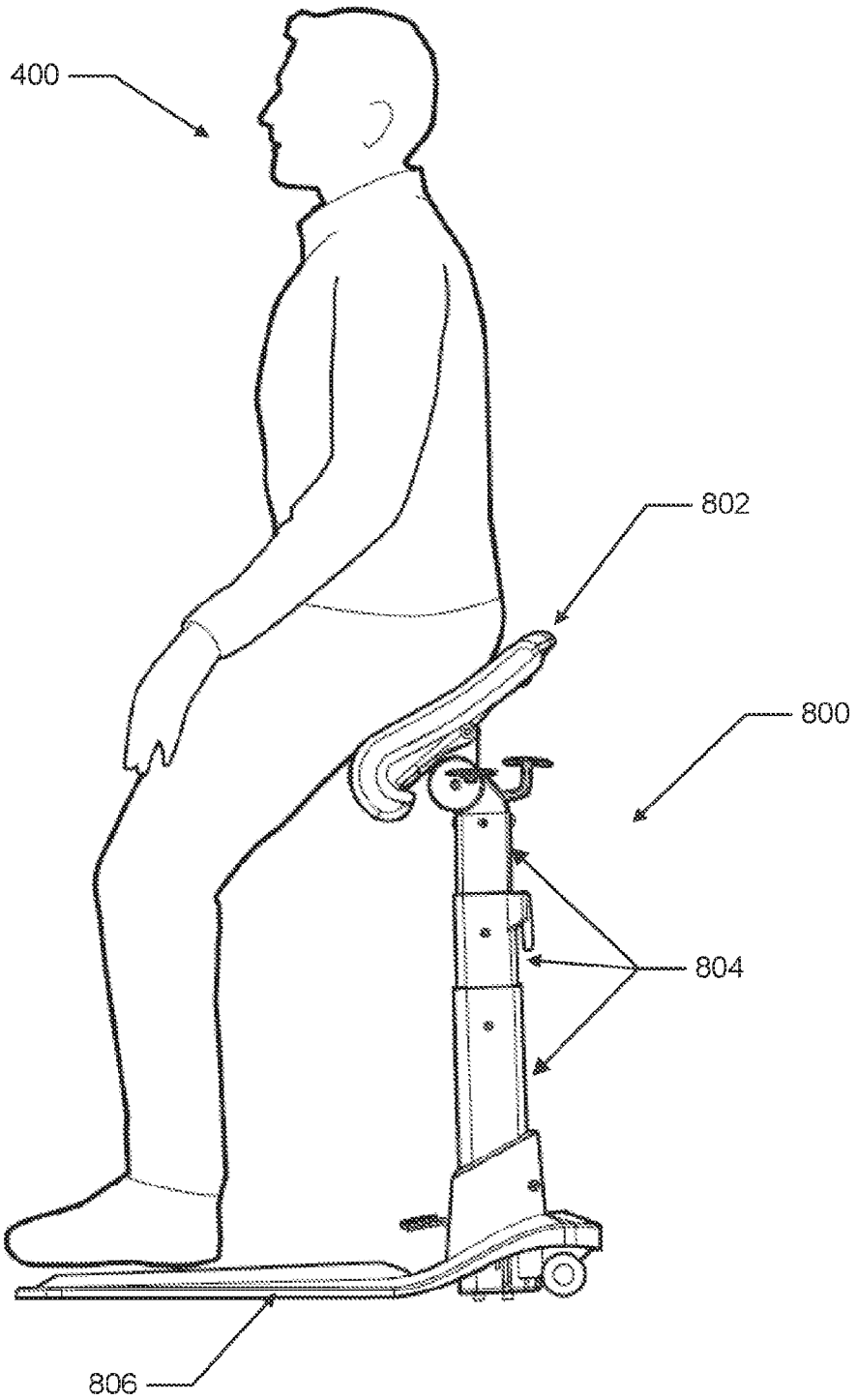
Figure 10A:
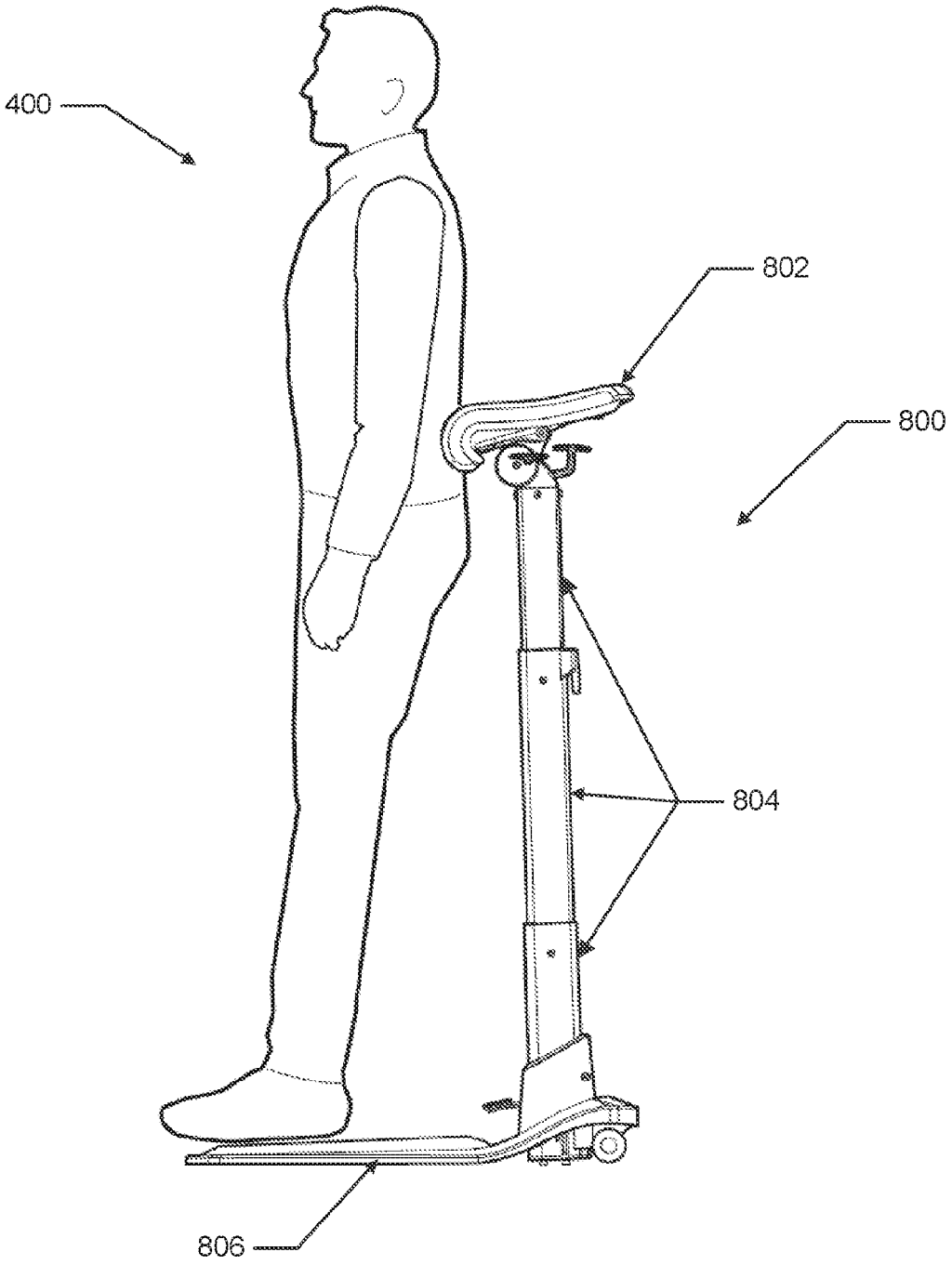
Figure 10B:
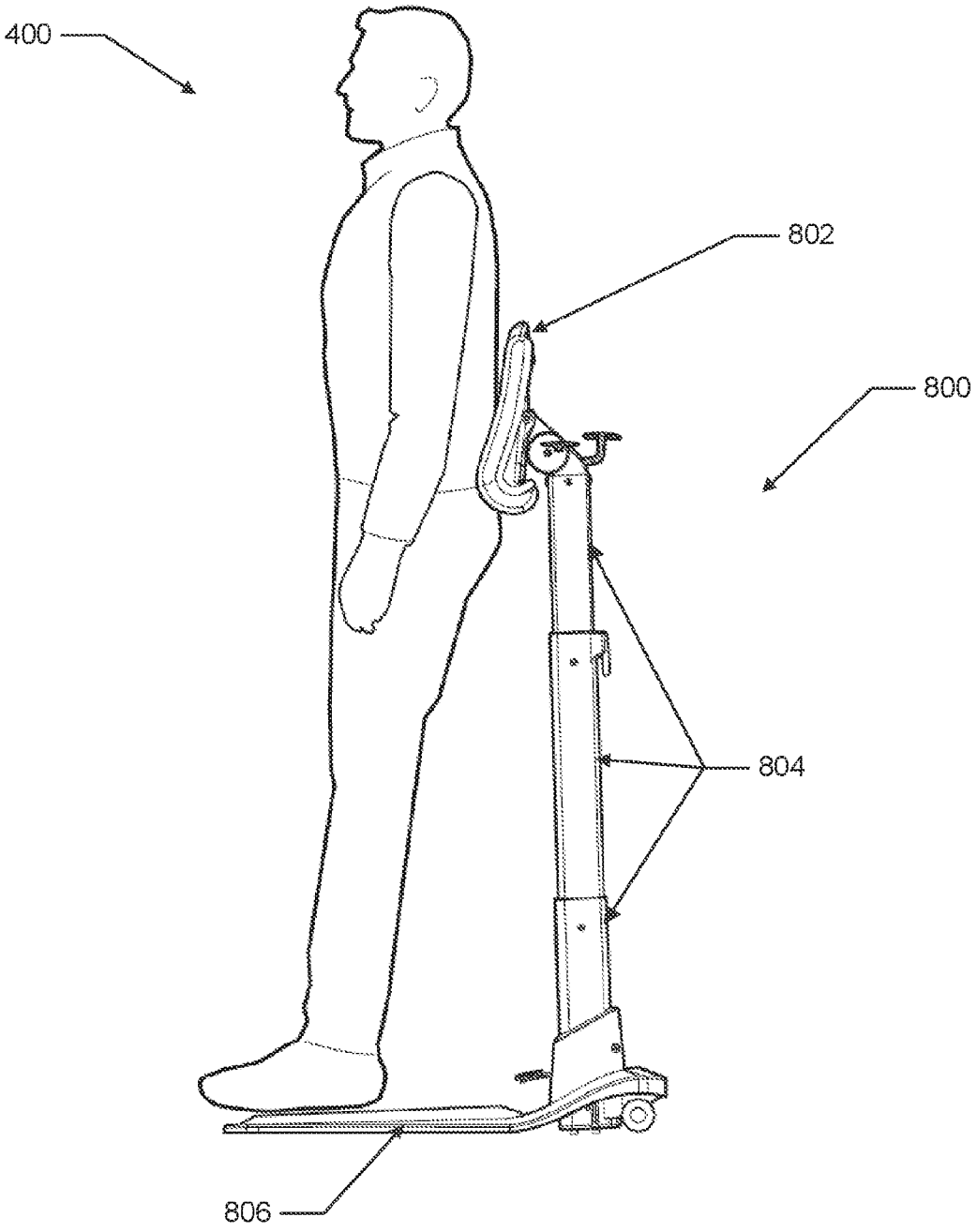

FIGS. 8, 9, 10*a*, and 10*b* illustrate an alternate embodiment of a seating apparatus as disclosed herein. In the embodiment illustrated in FIGS. 8, 9, 10*a*, and 10*b*, the seating apparatus 800 enables a person 400 to sit on or lean against the apparatus in a plurality of different positions, similar to the discussion of FIGS. 1 to 7 above. FIGS. 8, 9, 10*a*, and 10*b* illustrate an embodiment of the disclosed seating apparatus that includes a seat portion 802, a base portion 806 similar to the embodiments of FIGS. 1 to 7. FIGS. 8, 9, 10*a*, and 10*b* further illustrate an adjustable stem portion 804 that includes three sections. It should be appreciated that in this embodiment, the use of three or more nesting portions in stem portion 804 enables the disclosed seating apparatus 800 to reach the desired upper height (e.g., as shown in FIGS. 10*a* and 10*b*) while also enabling a relatively lower seated position (e.g., as shown in FIG. 8) than the embodiment of FIGS. 1 to 7 because the lowest position of FIG. 8 is defined by the longest stem portion 804.

In FIG. 8, the person 400 is seated atop the seat portion 802 of the seating apparatus 800, which is in a lowest position. In this embodiment, the backside of the user's upper legs are illustrated as contacting the top contour (i.e., the longer contour) of the seat portion 802. In a further embodiment, it should be appreciated that depending on the size of the seat portion 802 and the position of the person 800, the back of the person's knees could contact a front contour (i.e., the shorter contour) of the seat portion 802, further stabilizing the person in a seated position.

In FIG. 9, the person 400 is perched on or leaning against the seat portion 802 of the seating apparatus 800 while the apparatus 800 is in a medium-height position. As can be seen from FIG. 9, the seat portion 802 is partially tilted, such that the top contour still contacts the underside of the person's upper legs. In this position, however, the person's legs are bearing some his or her weight.

FIGS. 10*a* and 10*b* illustrate the apparatus 800 in an fully extended, or highest, position. As can be seen from FIG. 10*a*, the seat portion 802 in this embodiment can be pivoted such that the front contour is contacting the person's lower back. This can provide the person with targeted, relatively more intense lumbar support and thus can be advantageous for improving posture while standing. FIG. 10*b* illustrates the seat portion 802 in a second pivoted position, such that the top contour is contacting a larger portion of the person's lower back. In this position, the apparatus 800 provides more dispersed lumbar support while still enabling the person to lean against the apparatus. In either position illustrated in FIG. 10*a* or 10*b*, it should be appreciated that the person's legs are supporting the majority of his or her body weight.

Figure 11:
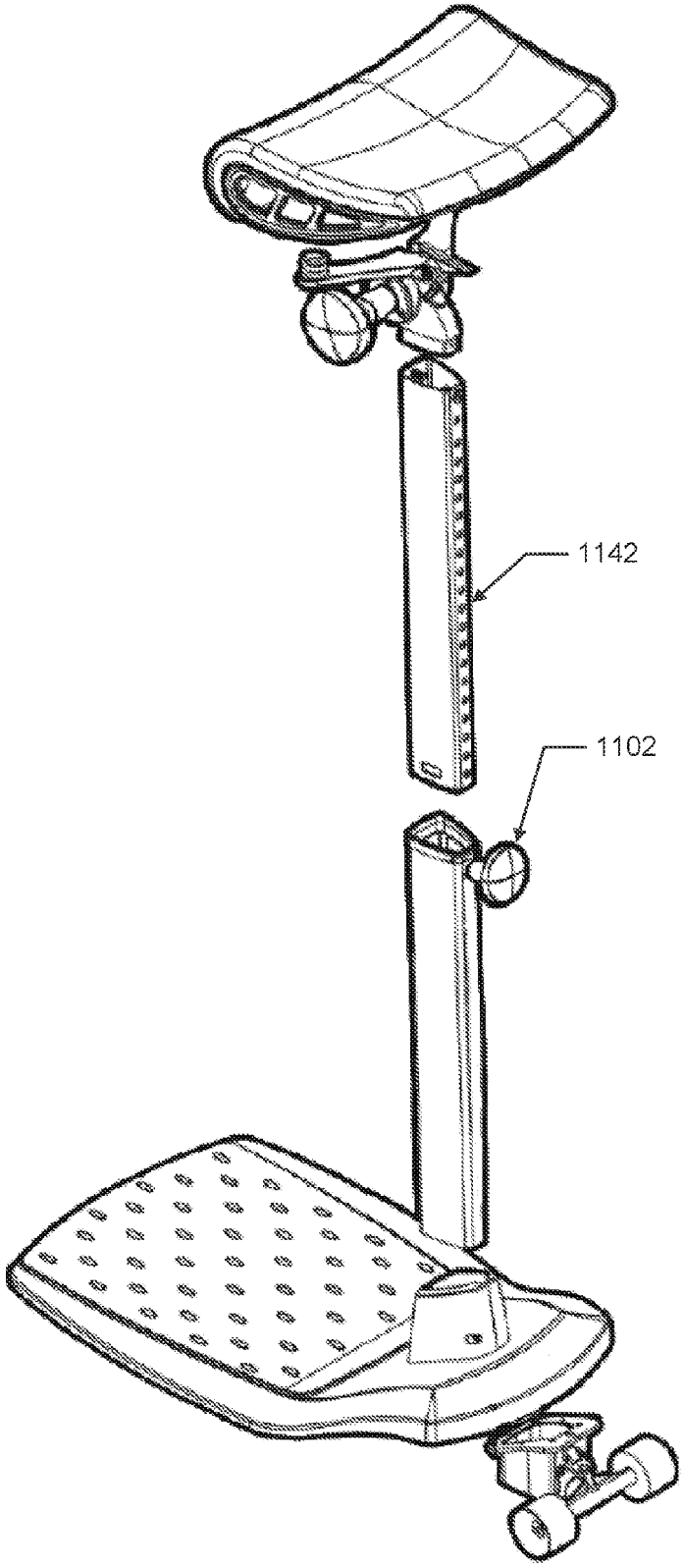
FIG. 11 is an exploded view of an alternate embodiment of the disclosed seating apparatus having a different height adjustment locking mechanism.
Figure 12:
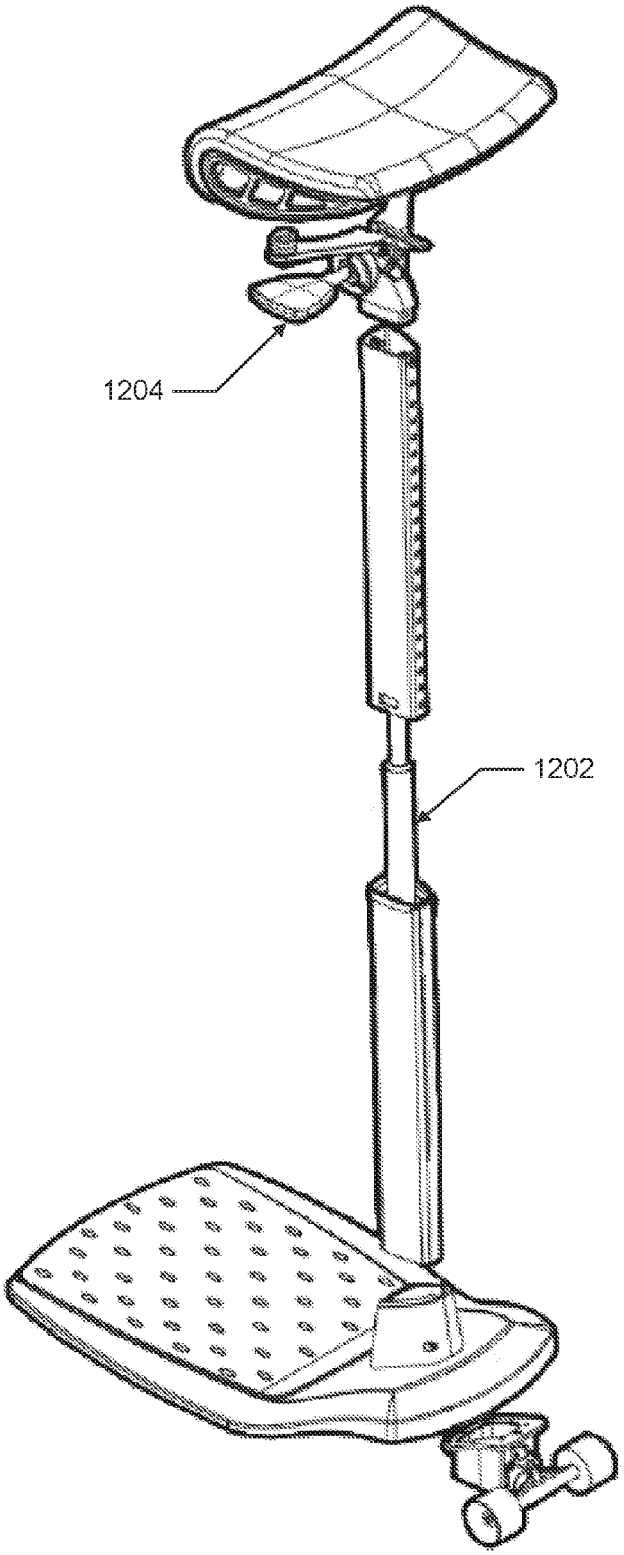
FIG. 12 is an exploded view of an alternate embodiment of the disclosed seating apparatus having a different height adjustment locking mechanism.
Figure 13:
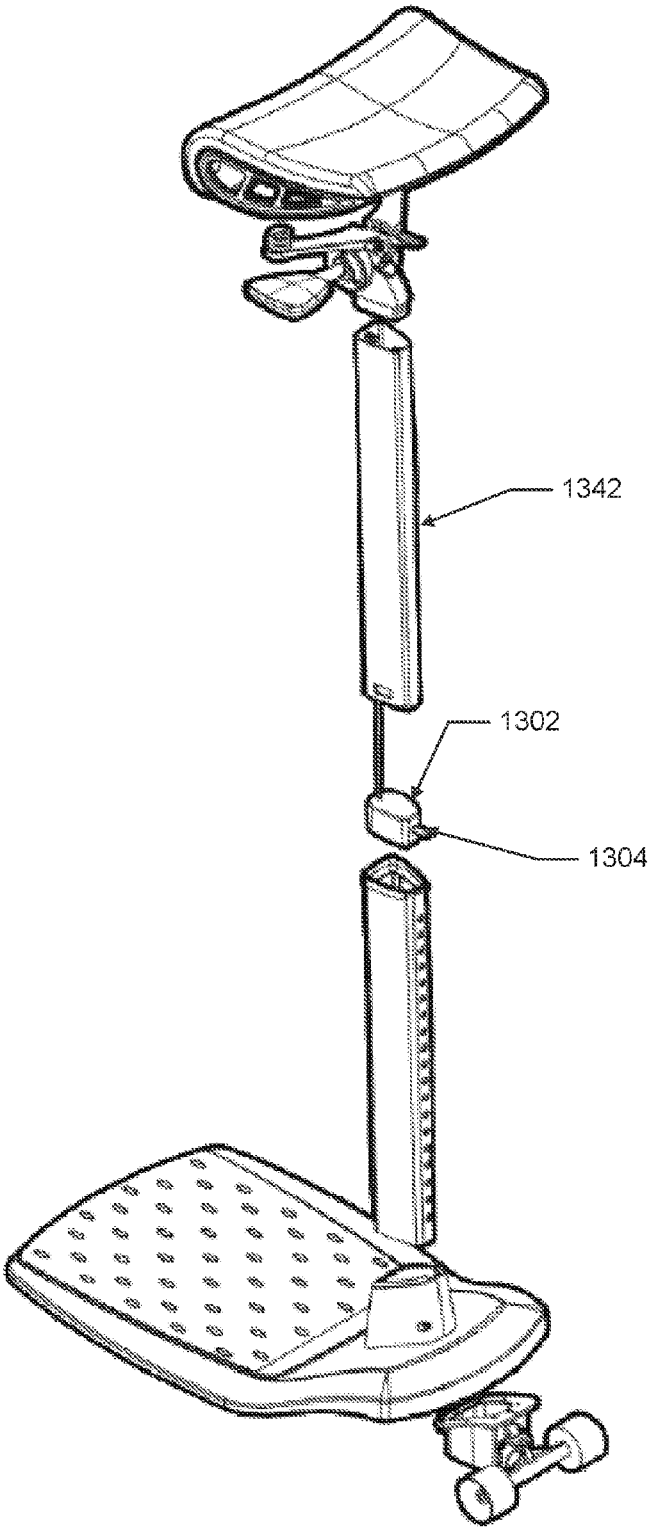
FIG. 13 is an exploded view of an alternate embodiment of the disclosed seating apparatus having a different height adjustment locking mechanism.

FIGS. 11, 12, and 13 illustrate exploded views of alternate embodiments of the disclosed seating apparatus having different height adjustment mechanisms. Specifically, in the embodiment of FIG. 11, a knob 1102 can be rotated and/or pulled to disengage a pin (not illustrated) from the plurality of holes of the nesting portion 1142. In this embodiment, actuating the knob 1102 to release the pin from the nesting portion 1142 enables a user to adjust the seat height of the disclosed seating apparatus. The embodiment of FIG. 12 illustrates an alternate seat height adjustment mechanism 1202, which is a pneumatic apparatus that allows a user to adjust the height of the seat by actuating lever 1204 to move the pneumatic mechanism 1202 to the desired height. The embodiment of FIG. 13 illustrates an embodiment in which a height adjustment mechanism 1302 includes a spring-loaded pin 1304. In this embodiment, a user can push the pin 1304 inward to disengage it from the plurality of illustrated holes in the nesting portion 1342, which in turn enables the seat height to be adjusted upward or downward as desired. When the user has moved the seat to a desired height, the spring-loaded pin 1304 releases and engages the appropriate hole in the nesting portion 1342, fixing the seat at the desired height.

Figure 14:
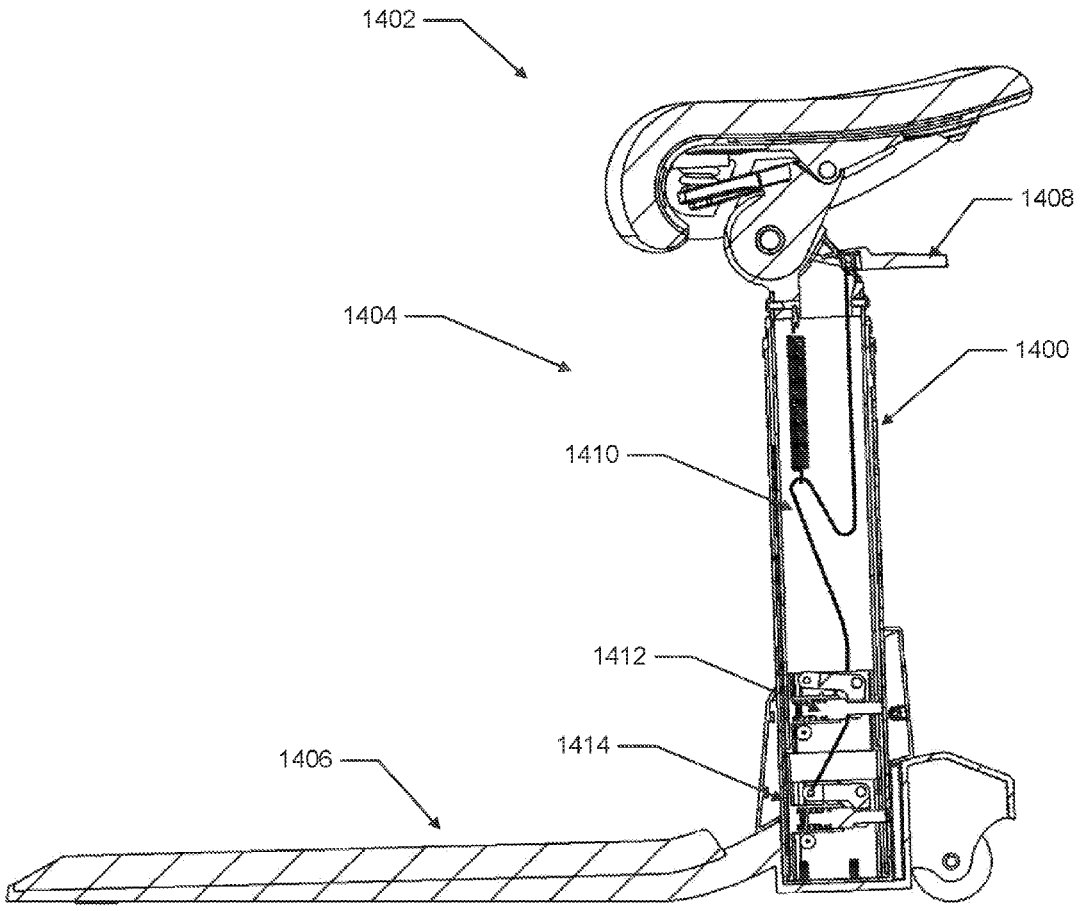
FIG. 14 is a cutaway side view of an alternate embodiment of the disclosed seating apparatus having a three-part nesting stem portion.
Figure 15:
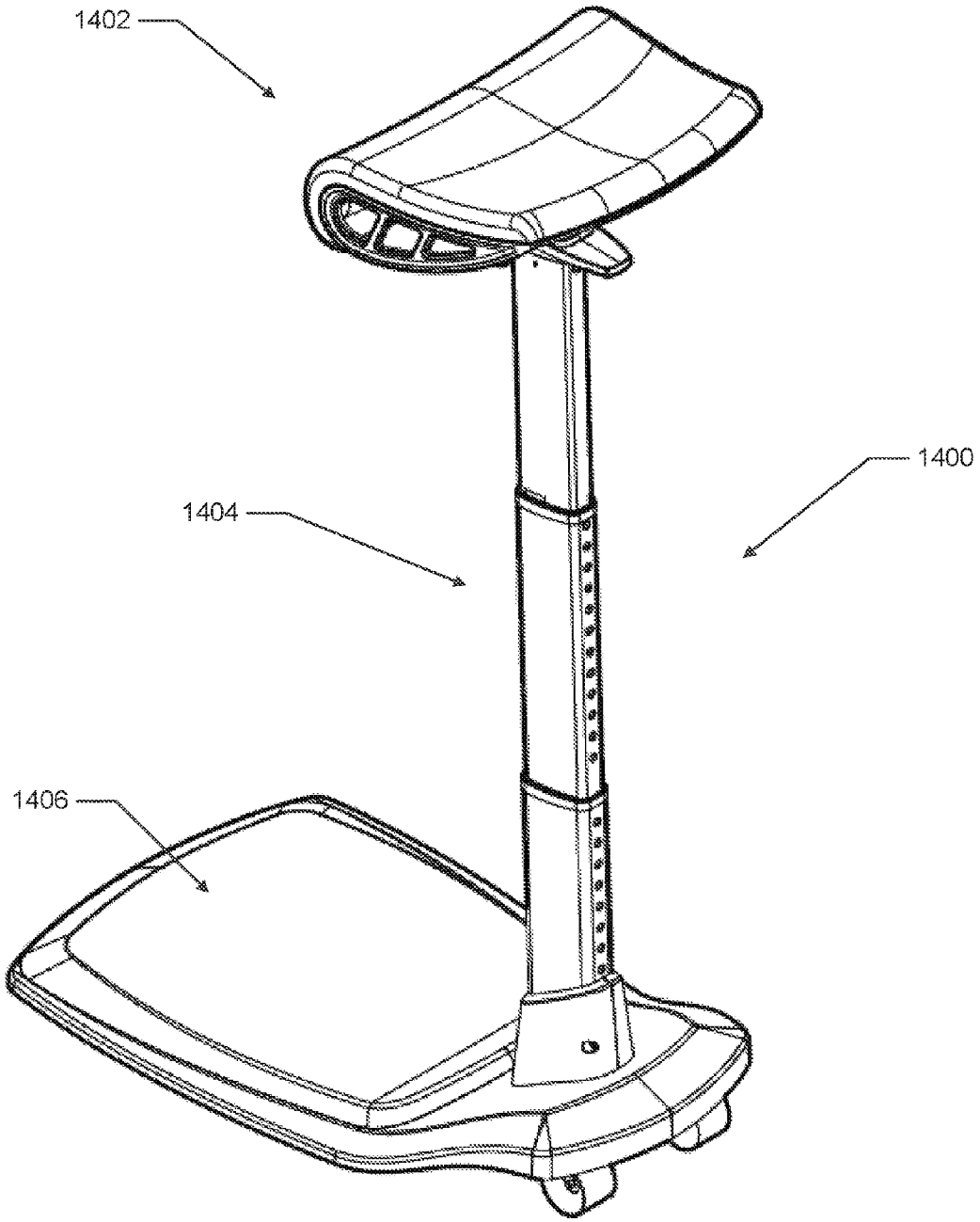
FIG. 15 is a perspective view of the embodiment of FIG. 14.

Referring now to FIGS. 14 and 15, an alternate embodiment of the disclosed seating apparatus 1400 is illustrated as a cutaway of a side view (FIG. 14) and a perspective view (FIG. 15). FIG. 14 also illustrates certain internal elements of the apparatus while in a lowered position, while FIG. 15 illustrates the seat portion 1402 in an upward extended position. In this embodiment, the seating apparatus 1400 includes several major sub-components. For example, the embodiment of FIG. 14 includes a seat portion 1402. Seat portion 1402 engages with different parts of the user's body depending on the height and position of the seat portion 1402. FIG. 1 also illustrates an adjustable stem portion 1404 and a base portion 1406. The adjustable stem portion 1404 enables the height of the seat portion 1402 to be adjusted with regard to the base portion 106, as will be discussed in more detail below.

In the embodiment of FIGS. 14 and 15, the adjustable stem portion 1404 is constructed of three parts, although in other embodiments more than three parts may be used depending on the range of heights desired. In the illustrated embodiment, the three-part adjustable stem portion 1406 enables the seat portion 1402 to be lowered farther than if the stem portion 1406 were provided in two parts. It should be appreciated that the various embodiments discussed elsewhere herein could take advantage of the three-part stem portion design of FIG. 14.

In the illustrated embodiment, a lever 1408 and a cable 1410 are provided to enable the seat height to be adjusted. Specifically, in this embodiment, actuating the lever 1408 pulls on the cable 1410, which in turn retracts two internal pins 1412 and 1414 from engagement with all three stem portions. Retraction of the pins 1412 enables the operator to raise and lower the seat portion 1402 as desired. When a desired height is achieved, releasing the lever 1408 releases the cable 1410 and causes pins 1412 and 1414 to re-engage with respective aligned holes of the three stem portions. Following such engagement, the stem portions cannot move again without re-actuating the lever 1408 and correspondingly disengaging the pins 1412 and 1414.

Figure 16B:
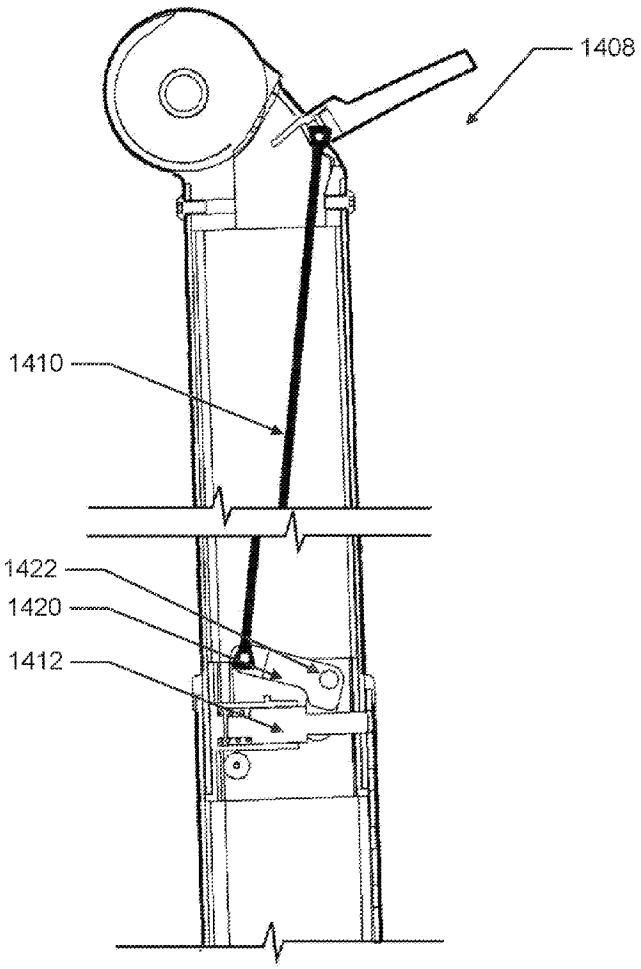
FIGS. 16A and 16B are close-up, cutaway views of an exemplary lock pin in an engaged (FIG. 16A) and disengaged (FIG. 16B) position.
Figure 16A:
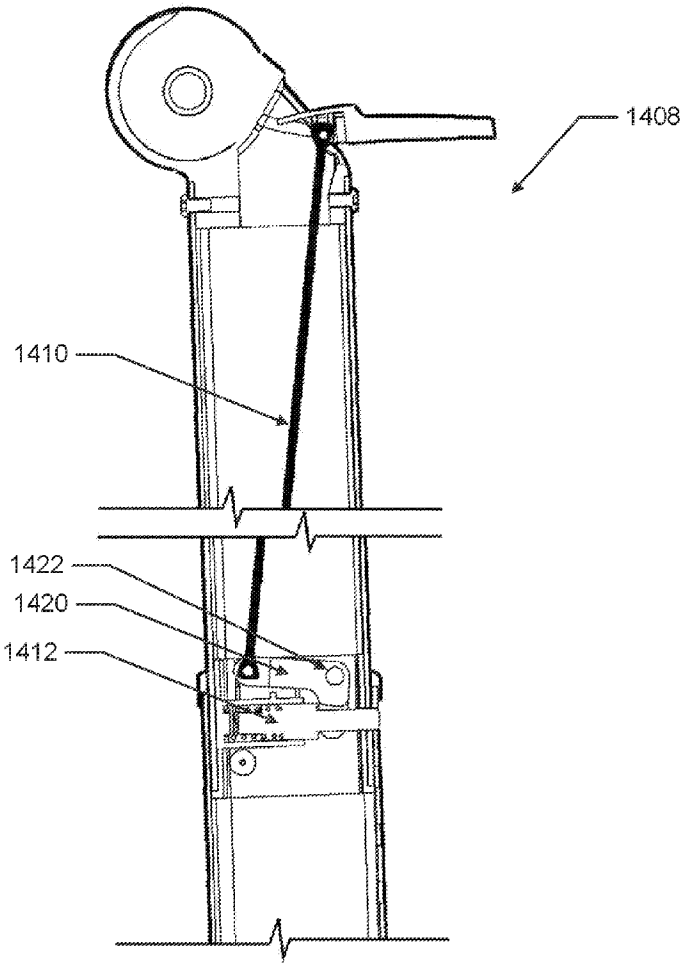

FIGS. 16A and 16B illustrate cutaway side views of the motion of the lever 1408 and the corresponding motion of an exemplary pin (1412) caused by the motion of the lever 1408. In FIG. 16A, the lever is in a down position and the cable 1410 is not tensioned. In FIG. 16B, the lever is raised, causing the cable 1410 to tighten. This actuates a rocker 1420 that pivots at point 1422 driving pin 1412 leftward and disengaging it with the holes in the stem. When the lever is released, the rocker 1420 pivots back (e.g. by virtue of a spring biasing the pin 1412 rightward) and the pin re-engages with whatever holes it is aligned with, as can be seen in FIG. 16A.

Figure 17:
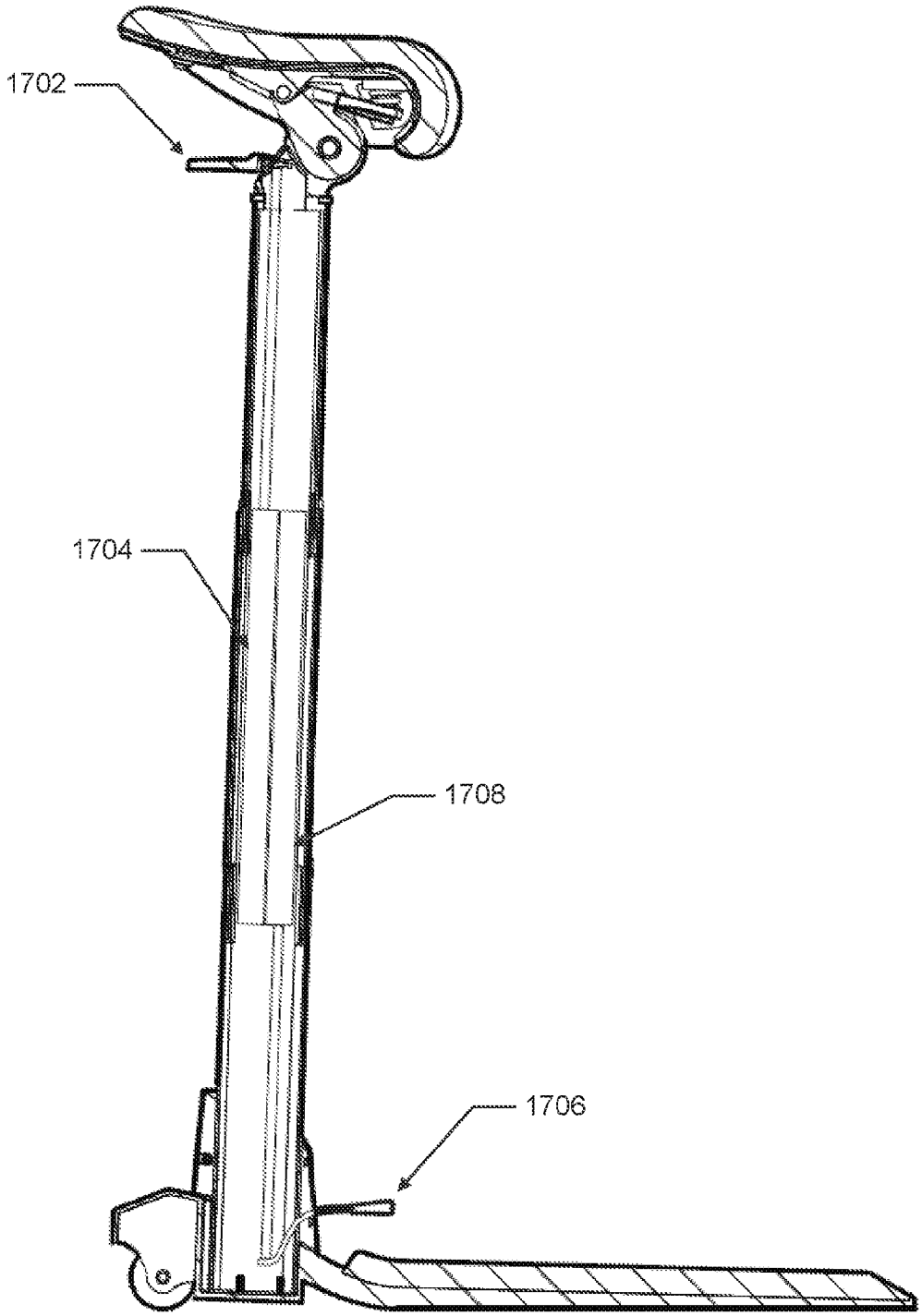
FIG. 17 is a side schematic view of an alternate embodiment of the disclosed seating apparatus relying on a plurality of gas cylinders to raise and lower the seat.

It should be appreciated that in various embodiments, other raising/lowering mechanism can be used. For example, a gas cylinder arrangement or a single pin arrangement could be used. FIG. 17 illustrates one such embodiment. In this embodiment, lever 1702 releases a first cylinder 1704 such that the cylinder extends the seat portion upward if little or no weight is placed on the seat and downward if sufficient weight is placed on the seat. Similarly, foot lever 1706 releases a second cylinder 1708 such that cylinder extends the seat portion upward if little or no weight is placed on the seat and downward if sufficient weight is placed on the seat. In this embodiment, if a user desires to raise the seat, actuating the upper lever 1702 and the lower lever 1706 allows the user to adjust the seat portion to a desired height within the full range provided for by the device.

In certain embodiments, multiple levers (e.g., one lever per pin) could be used as desired, for example in the gas cylinder embodiment as shown in FIG. 17. In the context of a locking pin embodiment, a pair of levers could be provided that each actuates a different pin, such that manipulation of both levers would be needed to move the seat through its full range of heights.

Figure 18:
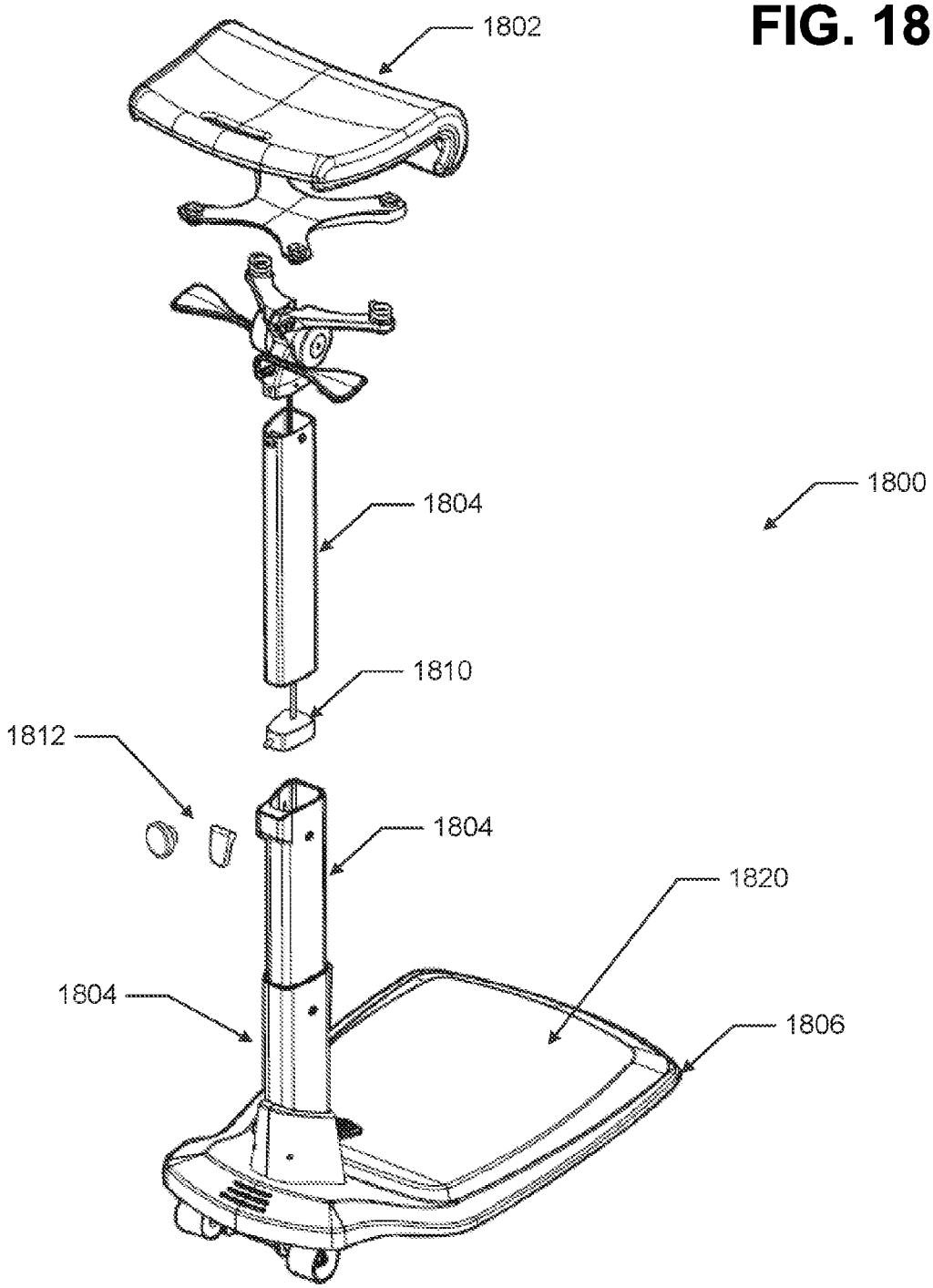
FIG. 18 illustrates an exploded plan drawing of an embodiment of the disclosed seating apparatus that relies on a gas cylinder and a pin arrangement to adjust seat height.

FIG. 18 illustrates an exploded view of one embodiment of a seating apparatus 1800 as disclosed herein. The illustrated embodiment relies on three stem portions 1804 to adjust the height of seat portion 1802 relative to the base portion 1806. In addition, the embodiment of FIG. 18 includes as pad portion 1820 that cushions a user's feet when he or she is standing on the apparatus 1800 for an extended period of time. In the embodiment of FIG. 18, a gas cylinder (not shown) and an indexing pin 1810 are used to adjust the height of the seat portion 1802. Specifically, a know 1812 is used to selectively engage the pin portion 1810 at a desired height of the top stem portion 1804, and an un-illustrated gas cylinder, actuated by foot pedal 1814, can be actuated to adjust the height of the middle stem portion 1804 relative to the bottom stem portion 1804. Using the combination of the disclosed gas cylinder and indexing pin, the disclosed apparatus can have its height adjusted from a lowest position to a highest position, and at several points between, as described elsewhere herein.

Figure 19:
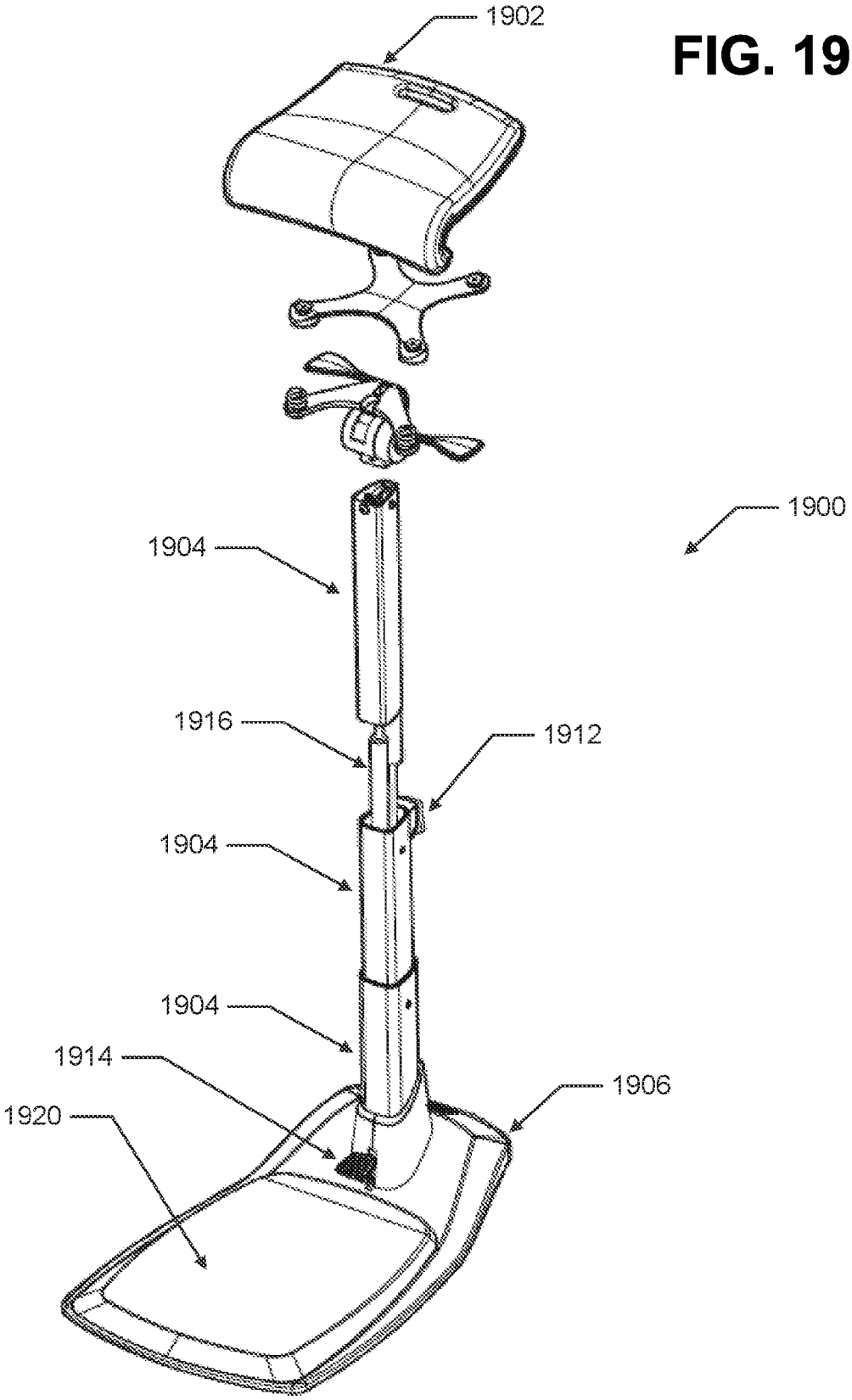
FIG. 19 illustrates an exploded plan drawing of an embodiment of the disclosed seating apparatus that relies on a pair of gas cylinders to adjust seat height.
Figure 20:
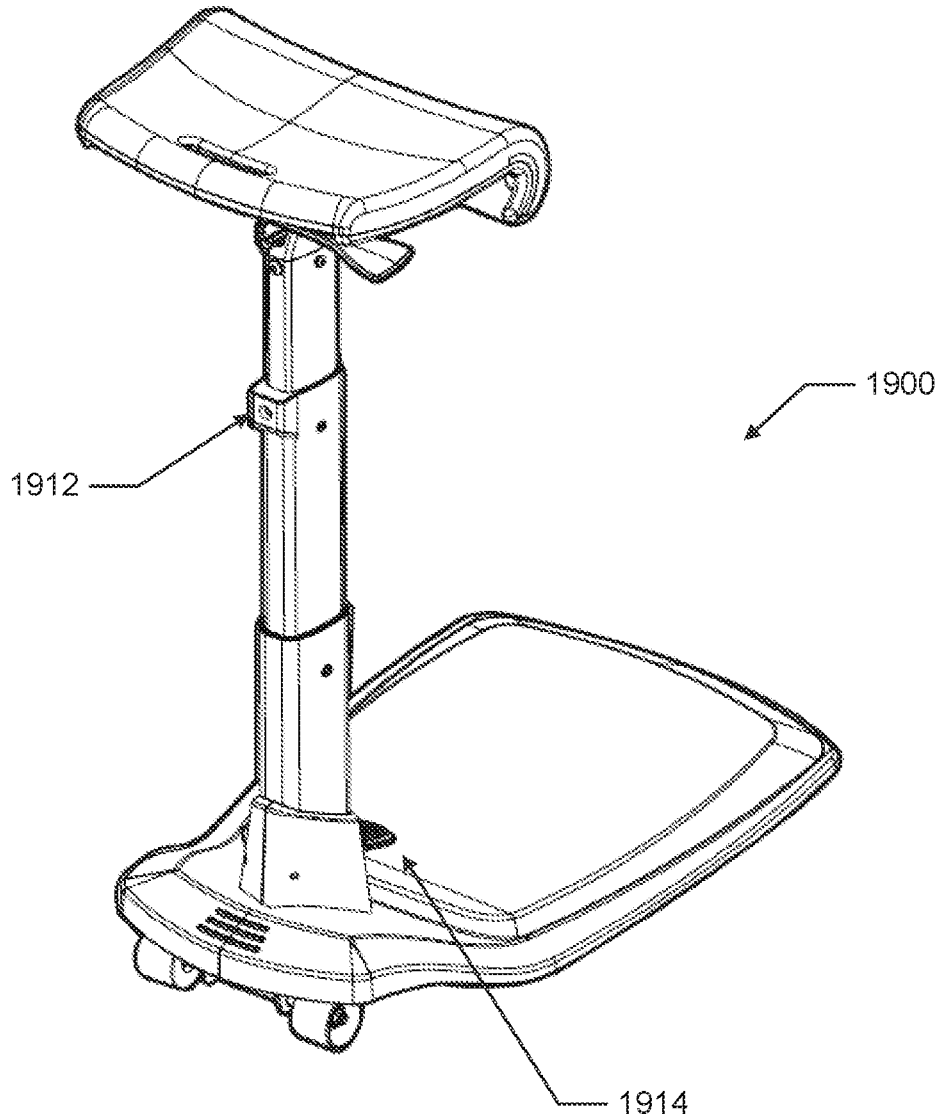
FIGS. 20 and 21 are front and back views of the embodiment of FIG. 19 with the seat portion in a lowered position.
Figure 21:
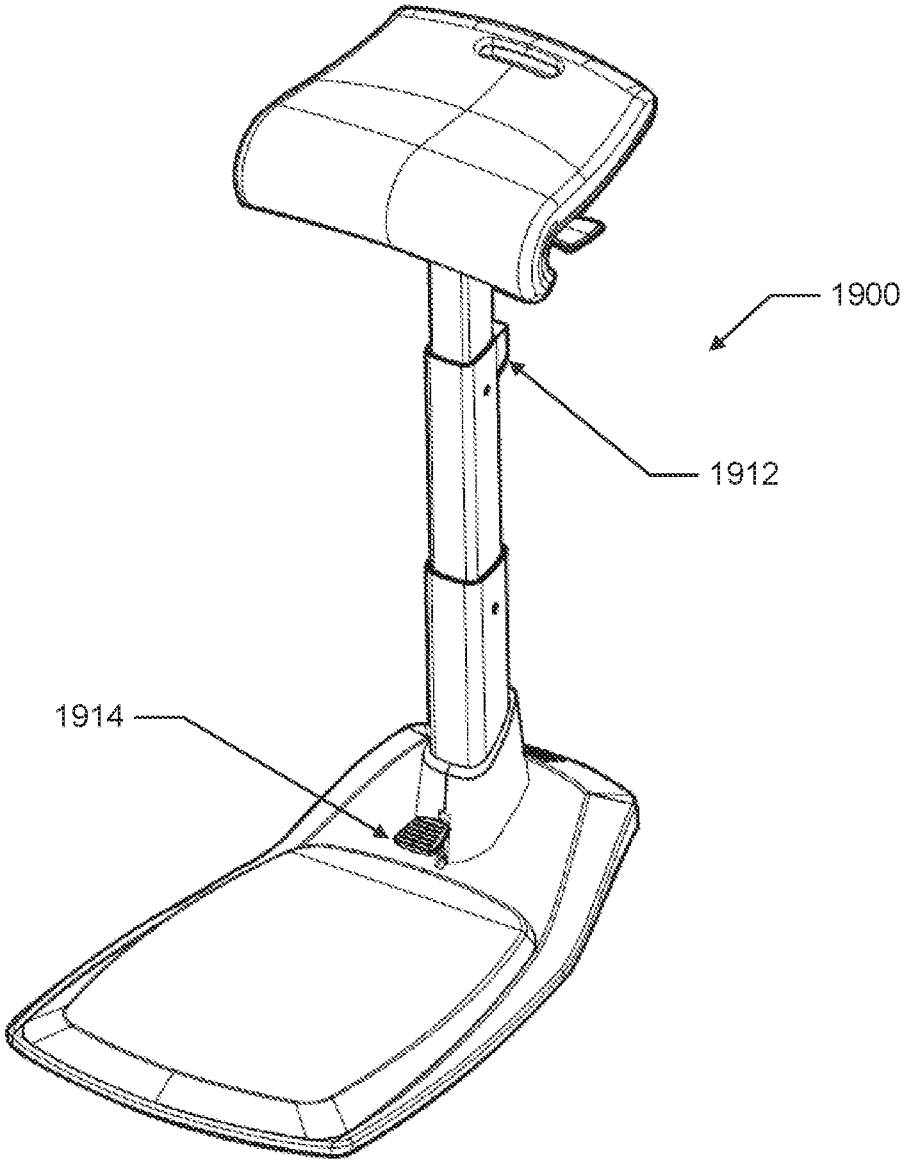

FIG. 19 illustrates an exploded view of another embodiment of a seating apparatus 1900 as disclosed herein. Particularly, FIG. 19 corresponds with the cutaway side view illustrated in FIG. 17, in which a plurality of cylinders can be used to move the seat portion up and down within a full range of movement. The illustrated embodiment relies on three stem portions 1904 to adjust the height of seat portion 1902 relative to the base portion 1906. In addition, the embodiment of FIG. 19 includes as pad portion 1920 that cushions a user's feet when he or she is standing on the apparatus 1900 for an extended period of time. In the embodiment of FIG. 19, two gas cylinders 1916 partially visible in the illustrated, exploded view can be used to adjust the height of the seat portion 1902. In the illustrated embodiment, a button 1912 actuates one of the cylinders, enabling the top stem portion 1904 to be raised and lowered (and correspondingly raising and lowering the seat portion 1902). In addition, a foot pedal 1914 actuates a lower gas cylinder, enabling the middle stem portion 1904 to move relative to the lower stem portion 1904. Using the combination of gas cylinders, the disclosed apparatus can have its height adjusted from a lowest position to a highest position, and at any position between those points, as described elsewhere herein. FIGS. 20 and 21 show a back view and front view, respectively, of the seating apparatus 1900 illustrated in FIG. 19 in a lowered (sitting) position. It should be appreciated that this position can be achieved by actuating lever 1914 and button 1912 and pushing the seat to the desired (illustrated) height.

Figure 22:
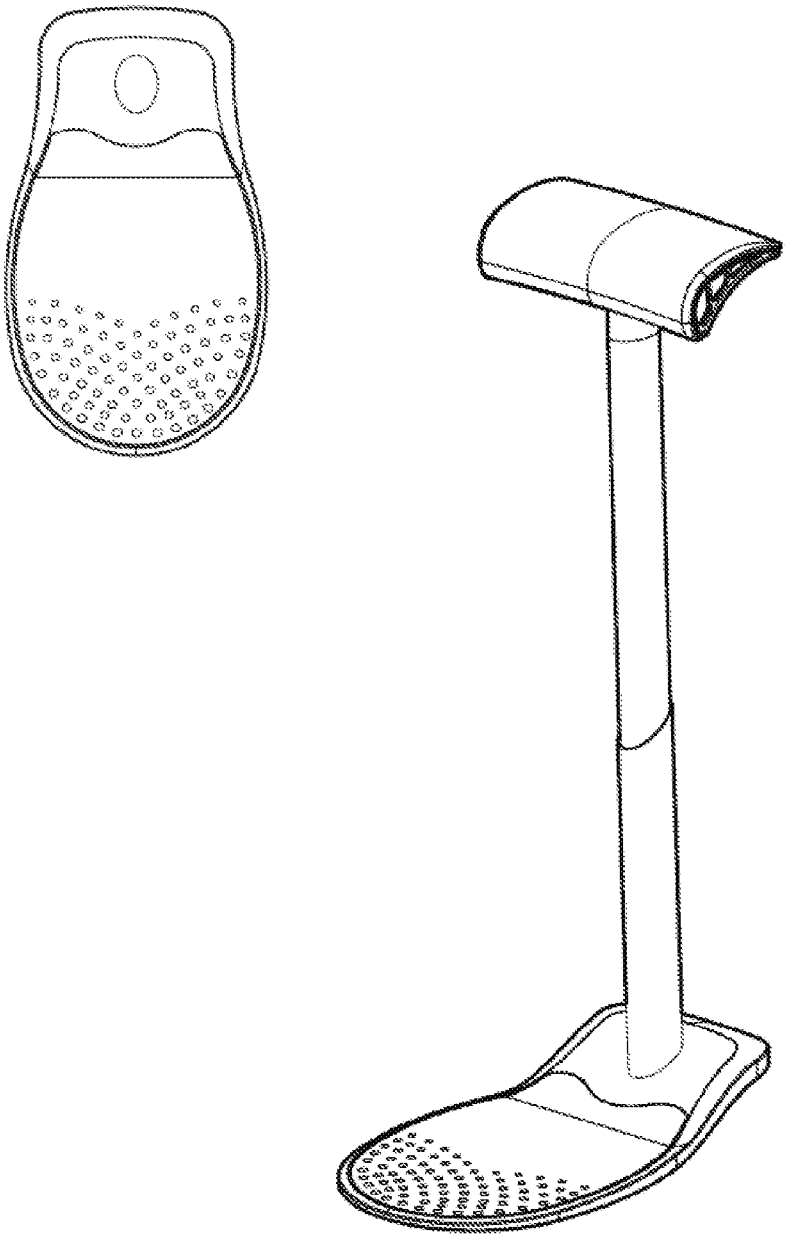
FIGS. 22, 23, and 24 illustrate different embodiments of the disclosed seating apparatus having different seat portion contours.
Figure 23:
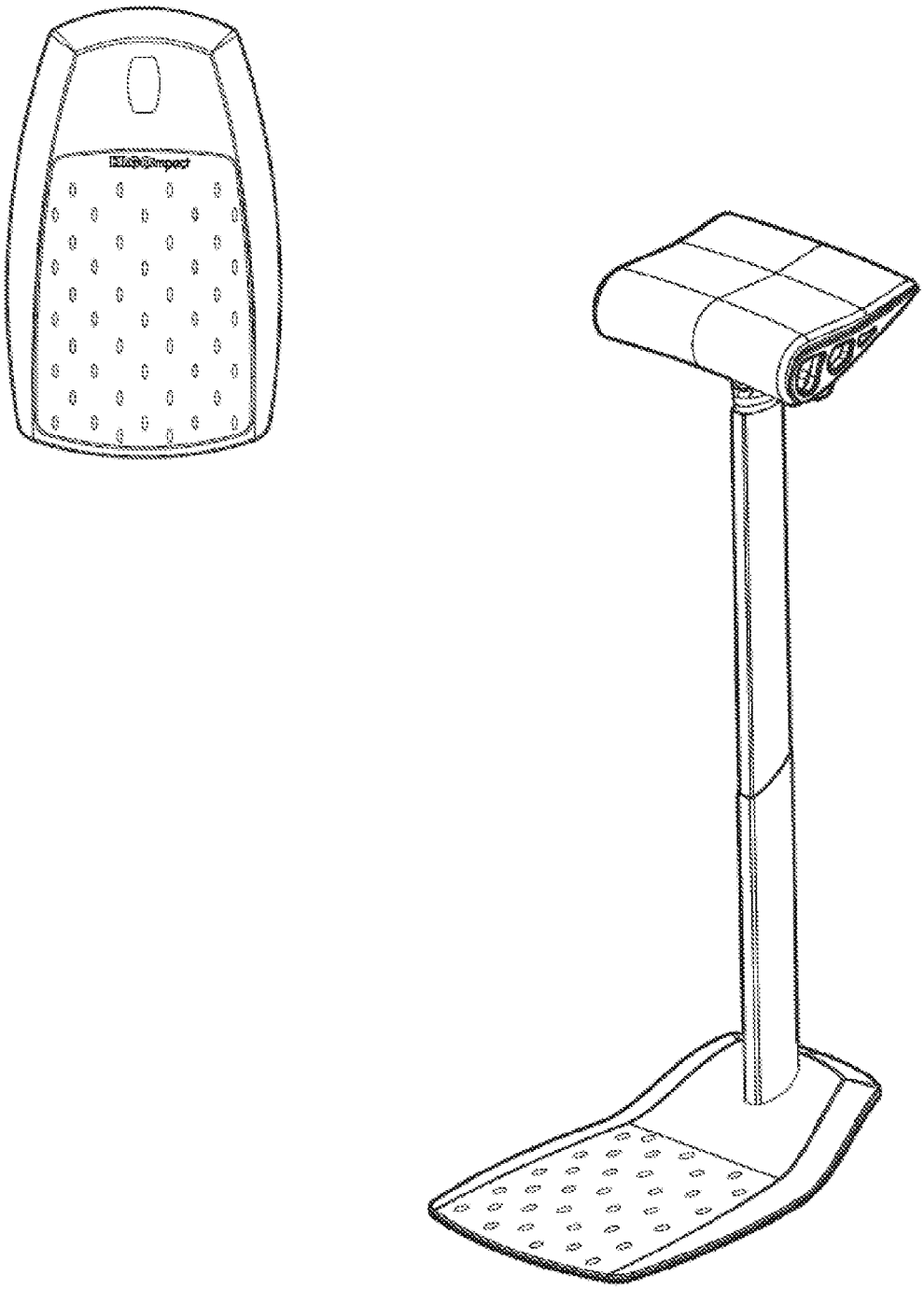
Figure 24:
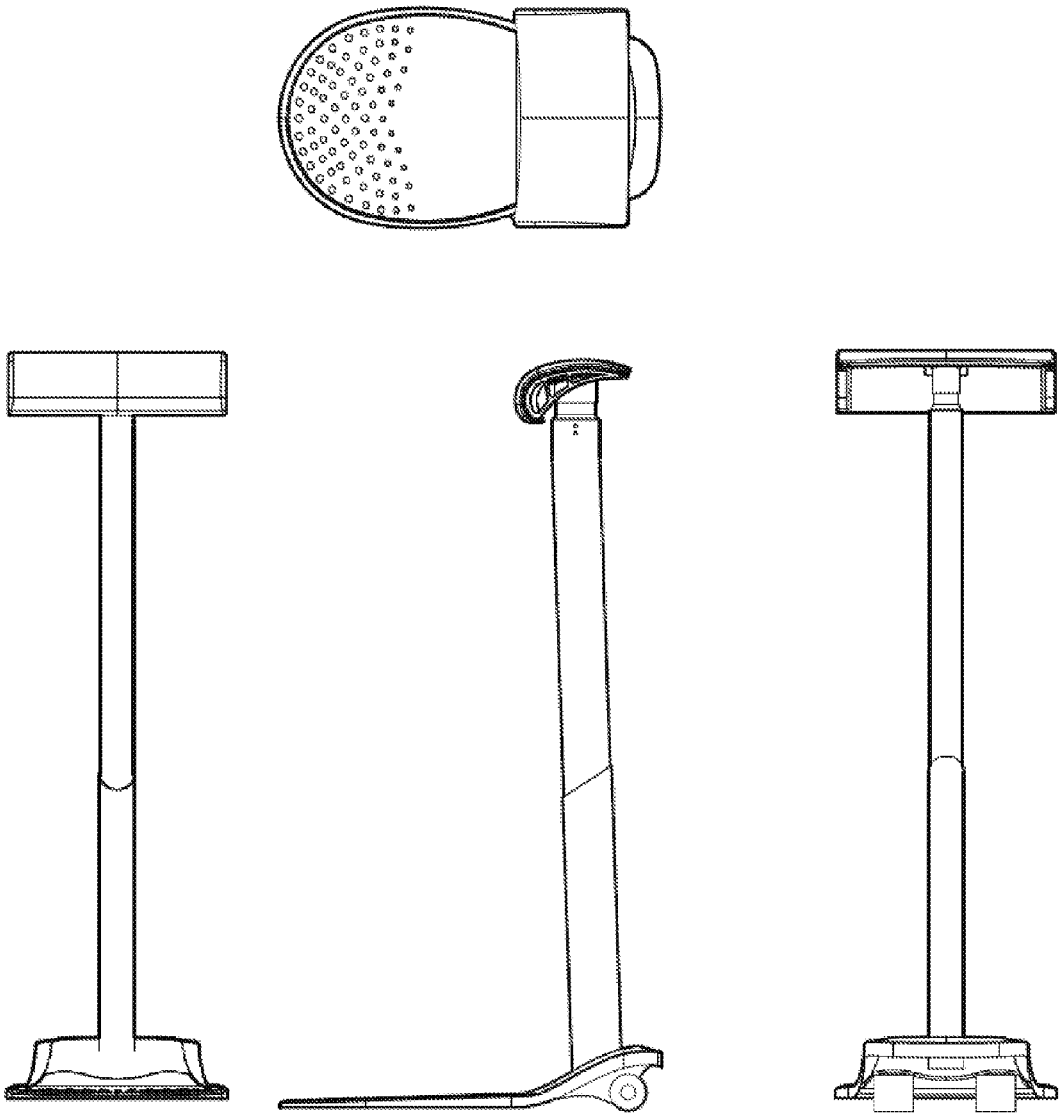

FIGS. 22, 23, and 24 illustrate embodiments of the disclosed seating apparatus having different seat portion contours. Specifically, in FIG. 22, the seat portion has a similar cross-section to that of FIGS. 1-7, but does not have a concave lateral shape. FIG. 23 illustrates an embodiment of the seat portion in which the seat has a convex cross section. In this embodiment, the seat portion is configured to more fully engage the user's core and acts more as a perch than a seat. Also in this embodiment, the seat portion provides less support if a user leans back than the seat portion of FIGS. 1-7. FIG. 24 also illustrates an embodiment wherein the seat portion has a convex cross section. However, in FIG. 24 the curve is more pronounced and there is less surface area to the seat portion. In embodiments like that of FIG. 24, the seat portion may not tilt, as the more severely curved cross section may provide the user with the ability to adjust the contour of the portion of the seat contacting the user's lower back simply by adjusting the height of the seat portion.

In one embodiment, the disclosed seating apparatus does not rely on a knob to adjust the tilt angle but instead relies on a spring-loaded seat flex mechanism. In this embodiment, the spring-loaded mechanism enables the user to adjust the seat tilt by leaning against the seat at different angles. The seat then pivots about a pivot point to the appropriate angle for the pressure applied by the user, and returns to a neutral of horizontal position when the user stands up from the seating apparatus.

In one embodiment, the base portion includes a pad to cushion the user's feet while the user sits or stands on the seating apparatus. In this embodiment, appropriate foam, solids, or liquids are included within the pad of the base portion to reduce pressure and stress on the user's feet while standing or sitting on the seating apparatus.

In one embodiment, the disclosed seating apparatus is die cast from an appropriate material, such as aluminum. In various embodiments, one or more portions of the seating apparatus include cushioning applied to the die cast structural components, such as the base portion or the seat portion. In some embodiments, one or more components (such as the seat portion) are made from plastic due to less severe structural strength requirements.

In various embodiments, the disclosed apparatus is able to adjust its height in one or more of the following ways:

1. A user pulls a pin by hand to raise and lower a seat;
2. A user steps on a foot step to release an engagement apparatus (such as a pin), whereupon the apparatus allows the user to raise and lower the seat;
3. A user engages a finger paddle control under the seat portion, which releases the engagement apparatus (such as a pin) to enable the user to raise and lower the seat; and/or
4. The apparatus includes a gas cylinder or other pneumatic device that enables the apparatus to shift from a perching position to a standing-only position. In this embodiment, a separate engagement apparatus (such as a pull-pin) enables the seat height to be altered.

In summary, the apparatus disclosed herein is configured to assist in keeping a user moving throughout the day by making it easier to stand longer and with better posture, perch-sit when desired, or fully sit as desired. In various embodiments, the disclosed apparatus enables various muscle groups to relax and then engage again as the user changes positions throughout the day. While embodiments of the disclosed apparatus may not fully remove weight form the user's feet as he or she leans against the apparatus, it alters how the leg muscles engage and therefore makes the user feel more supported, balanced and relaxed.

The above description of is exemplary of the features of the seating apparatus disclosed herein. It should be understood that various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A seating apparatus comprising:

an adjustable seat portion including a pivot apparatus and a pivot locking apparatus, wherein the pivot locking apparatus is selectively engageable at a plurality of pivot angles to set a pivot amount of the adjustable seat portion relative to horizontal;

a horizontal base portion extending forward of the adjustable seat portion in at least one direction;

a stem portion connected to the adjustable seat portion and the horizontal base portion, the stem portion including:

a first nesting support connected to the adjustable seat portion;

a second nesting support including a sleeve for receiving the first nesting support;

a third nesting support connected to the horizontal base portion, the third nesting support including a sleeve for receiving the second nesting support;

wherein the first nesting support, the second nesting support, and the third nesting support are telescopically movable relative to one another along a single axis to adjust the height of the adjustable seat portion relative to the horizontal base portion; and a height adjustment mechanism configured to selectively lock the height of the adjustable seat portion relative to the horizontal base portion.

2. The seating apparatus of claim 1, wherein the pivot angle and height of the adjustable seat portion are configurable in a plurality of positions, the plurality of positions including:

a sitting position wherein the height of the adjustable seat portion is at a lowest position and the pivot angle of the adjustable seat portion is substantially horizontal;

a leaning position wherein the height of the adjustable seat portion is higher than in the sitting position and the pivot angle of the adjustable seat portion is between substantially horizontal and substantially vertical; and a standing position wherein the height of the adjustable seat portion is higher than in the leaning configuration.

3. The seating apparatus of claim 2, wherein the height of the adjustable seat portion in the standing position is greater than twice the height of the adjustable seat portion in the sitting position.

4. The seating apparatus of claim 2, wherein the pivot angle of the adjustable seat portion in the standing position is substantially horizontal.

5. The seating apparatus of claim 2, wherein the pivot angle of the adjustable seat portion in the standing position is substantially vertical.

6. The seating apparatus of claim 1, wherein the adjustable seat portion includes a plurality of portions having different contours, and the plurality of portions having different contours are selectable by manipulating the pivot locking apparatus.

7. The seating apparatus of claim 6, wherein the adjustable seat portion includes a plurality of portions having different contours, the plurality of portions having different contours including:

a first contoured portion on a first side of the adjustable seat portion; and a second contoured portion on a second side of the adjustable seat portion, the second side substantially orthogonal to the first side.

8. The seating apparatus of claim 7, wherein the first contoured portion and the second contoured portion are both convex in a dimension along a first axis and are both flat or convex in a dimension along a second axis normal to the first axis.

9. The seating apparatus of claim 1, wherein the horizontal base portion includes at least one movement mechanism.

10. The seating apparatus of claim 9, wherein the horizontal base portion includes an upward sloping portion opposite the movement mechanism.

11. The seating apparatus of claim 9, wherein the at least one movement mechanism includes a set of wheels.

12. The seating apparatus of claim 1, wherein the horizontal base portion includes a pad portion.

13. The seating apparatus of claim 1, wherein the adjustable seat portion includes a plurality of different thicknesses of foam to provide for different amounts of support throughout a plurality of different contours.

14. The seating apparatus of claim 1, wherein the stem portion includes at least one pneumatic actuator selectively actuatable to position the adjustable seat portion at any one of a plurality of potential seat heights.

15. The seating apparatus of claim 1, wherein the height adjustment mechanism includes a gas cylinder.

16. The seating apparatus of claim 1, wherein the height adjustment mechanism includes two gas cylinders.

17. The seating apparatus of claim 1, wherein at least one of the nesting supports includes a plurality of holes associated with different adjustable seat portion heights, and the height adjustment mechanism includes a movable boss to selectively engage at least one of the plurality of holes associated with one of the different seat heights.

18. The seating apparatus of claim 1, wherein the height adjustment mechanism includes a gas cylinder and an indexing pin.

19. The seating apparatus of claim 1, wherein the height adjustment mechanism includes a pneumatic apparatus.

20. The seating apparatus of claim 19, wherein the height adjustment mechanism selectively locks the height of the adjustable seat portion relative to the horizontal base portion by selectively locking the pneumatic apparatus.

* * * * *